US009206817B2

(12) United States Patent
Mitsuishi et al.

(10) Patent No.: US 9,206,817 B2
(45) Date of Patent: Dec. 8, 2015

(54) CENTRIFUGAL BLOWER

(75) Inventors: Yasushi Mitsuishi, Anjo (JP); Masaharu Sakai, Obu (JP); Masanori Yasuda, Okazaki (JP); Shouichi Imahigashi, Kariya (JP); Syunsuke Ishiguro, Chiryu (JP)

(73) Assignees: NIPPON SOKEN, INC., Nishio-shi, Aichi (JP); DENSO CORPORATION, Kariya, Aichi-pref. (JP)

( * ) Notice: Subject to any disclaimer, the term of this patent is extended or adjusted under 35 U.S.C. 154(b) by 893 days.

(21) Appl. No.: 13/199,400

(22) Filed: Aug. 29, 2011

(65) Prior Publication Data

US 2012/0057971 A1 Mar. 8, 2012

(30) Foreign Application Priority Data

Aug. 31, 2010 (JP) ..... 2010-193541
Sep. 1, 2010 (JP) ..... 2010-195772
May 18, 2011 (JP) ..... 2011-111261

(51) Int. Cl.
*F04D 29/42* (2006.01)
*F04D 17/16* (2006.01)

(52) U.S. Cl.
CPC ..... *F04D 29/4213* (2013.01); *F04D 17/16* (2013.01); *F04D 17/162* (2013.01); *F04D 29/4226* (2013.01)

(58) Field of Classification Search
CPC . F04D 29/40; F04D 29/4226; F04D 29/4213; F04D 29/422; F04D 17/16; F04D 17/162
USPC ..... 415/203, 204, 205, 206, 207, 208.1, 415/211.1, 211.2, 212.1
See application file for complete search history.

(56) References Cited

U.S. PATENT DOCUMENTS 2,945,362 A * 7/1960 Gould et al. ..... 62/429
5,601,400 A * 2/1997 Kondo et al. ..... 415/119
5,813,831 A * 9/1998 Matsunaga et al. ..... 415/173.6
6,769,876 B2 * 8/2004 Sakai et al. ..... 416/187
6,821,088 B2 * 11/2004 Sakai et al. ..... 415/204
6,964,555 B2 * 11/2005 Ochiai et al. ..... 415/204

(Continued)

FOREIGN PATENT DOCUMENTS

EP 1 386 764 2/2004
JP 07-224796 8/1995

(Continued)

OTHER PUBLICATIONS

Office action dated Aug. 6, 2013 in corresponding Japanese Application No. 2010-193541.

(Continued)

*Primary Examiner* — Nathaniel Wiehe
*Assistant Examiner* — Eldon Brockman
(74) *Attorney, Agent, or Firm* — Harness, Dickey & Pierce, P.L.C.

(57) ABSTRACT

A centrifugal blower provided with a spiral shaped scroll chamber where a bottom part of the scroll chamber gradually expands downward in the axial direction of the fan well along with expansion of the spiral and where a flow area gradually expands toward an air outlet from a spiral start part of the casing, the centrifugal blower having an initial slant angle $\theta_0$ at the spiral start part of the bottom part of the scroll chamber of a range of angle of 5.2° to 27.5° or setting a backflow prevention rib at the fan outlet.

2 Claims, 21 Drawing Sheets

(56) References Cited

U.S. PATENT DOCUMENTS

| | | | | |
|---|---|---|---|---|
| 7,883,312 | B2 * | 2/2011 | Eguchi et al. | 415/119 |
| 8,591,177 | B2 * | 11/2013 | Yokoyama et al. | 415/119 |
| 2002/0025253 | A1 | 2/2002 | Ozeki et al. | |
| 2003/0012649 | A1 * | 1/2003 | Sakai et al. | 415/206 |
| 2010/0014965 | A1 | 1/2010 | Watanabe et al. | |

FOREIGN PATENT DOCUMENTS

| | | | |
|---|---|---|---|
| JP | 07224796 | A * | 8/1995 |
| JP | 2000-16050 | | 1/2000 |
| JP | 3231679 | | 9/2001 |
| JP | 2002-048097 | | 2/2002 |
| JP | 2003-193998 | | 7/2003 |
| JP | 2004-068644 | | 3/2004 |
| JP | 2004-270577 | | 9/2004 |
| JP | 2004-360497 | | 12/2004 |
| JP | 2006-307830 | | 11/2006 |
| JP | 2010-024953 | | 2/2010 |

OTHER PUBLICATIONS

Office Action issued Feb. 4, 2014 in corresponding JP Application No. 2011-111261 (with English translation).

* cited by examiner

△ ··· ONE EMBODIMENT OF PRESENT INVENTION OF FIG. 7

◆ ··· COMPARATIVE EXAMPLE OF FIG. 7

CENTRIFUGAL BLOWER

TECHNICAL FIELD

The present invention relates to a centrifugal blower provided with a scroll casing for automobile air-conditioning use.

BACKGROUND ART

A centrifugal blower used in an air-conditioning system for automobile use is, for example, disclosed in Japanese Unexamined Patent Publication No. 2004-360497. FIG. 24A is a cross-sectional view along the axial direction of a centrifugal blower of the prior art disclosed in Japanese Unexamined Patent Publication No. 2004-360497, FIG. 24B is a front view, and FIG. 24C is a plan cross-sectional view.

Such a conventional centrifugal blower is provided with a multi-blade fan 16 having a large number of blades 2, a motor 34 to an output shaft 33 of which this multi-blade fan 16 is attached, and a casing 31 housing the multi-blade fan 16 inside it and having a scroll chamber 30 formed in a spiral shape at an outer circumferential side of the multi-blade fan. The scroll chamber 30 is formed in a spiral shape which starts from a nose portion 1*a* of the casing 31 and gradually expands in passage toward the air outlet. In general, the center of rotation O of the multi-blade fan forms the center point of the scroll chamber. When the nose portion 1*a* is an arc shape, strictly speaking, the position showing the center of curvature of the nose portion 1*a* is the spiral start part (starting point of spiral casing). The starting point of the circumferential direction angle $\phi$ with respect to the center O is the center of curvature of the nose portion 1*a*. The nose portion is not limited to an arc shape. Here, the explanation will be given deeming the nose portion end part as a spiral start part.

The casing 31 has an air inlet 13 at one surface of the multi-blade fan 16 in the axial direction. When the motor 34 rotates, the multi-blade fan 16 sucks in air from the air inlet 13 to the center part of the multi-blade fan 16. The air is sucked into the center part of the multi-blade fan, then is given kinetic energy (dynamic pressure) by this multi-blade fan, has part of the dynamic pressure converted to static pressure in the casing while passing through the scroll chamber 30, and is discharged from the air outlet.

In this prior art, it is possible to reduce noise accompanying the formation of backflow near the nose portion 16. That is, the starting point 21*a* of the step 21 matches the spiral start part (that is, the circumferential direction angle $\phi$ (see FIG. 24C) from the spiral start part becomes 0°), while at the end point 21*c* of the step 21, the circumferential direction angle $\phi$ from the spiral start part becomes 10°. In this prior art, the end point 21*c* of the step 21 is defined as the starting point of the chamber part 35. The starting point of the chamber part 35 is $\phi$=10°.

The prior art aimed at reduction of the noise accompanying the formation of backflow, but provided a step for sharply expanding the shape of the bottom of the scroll chamber and sharply expanded the scroll chamber passage. For this reason, a sufficient noise reduction effect could not be obtained. The "backflow phenomenon" expresses the phenomenon where part of the flow in the case enters between the blades.

On the other hand, the prior art shown in Japanese Patent No. 3231679 prevents backflow occurring largely near the nose portion by a plate and thereby suppresses a drop in blower efficiency and suppresses the generation of noise due to this backflow. FIG. 25 is a cross-sectional view of a centrifugal blower of the prior art disclosed in Japanese Patent No. 3231679.

The prior art shown in this Japanese Patent No. 3231679 provides a plate 3' having a slanted part facing a main plate side 110 from a side plate side 109 of the multi-blade fan 16 in the axial direction of the air inlet 13 and has a maximum length part at the inside of the nose portion 1*a*. The distribution of peripheral speed in the direction of the electric motor shaft 33 at the outer circumference of the multi-blade fan 16 is not uniform (see Japanese Patent No. 3231679, FIG. 14), so if the blower static pressure becomes larger, backflow is formed from the side plate side 109 of the multi-blade fan 16 near the nose portion. In particular, the backflow formed large near the nose portion is prevented by the plate 3'. In this prior art, the plate 3', set from the inlet side of the blades, is provided at the location where backflow is formed so as to solve this problem.

The plate 3' at Japanese Patent No. 3231679, as shown in FIG. 25, is provided between the air inlet 13 and the inlet side of the blades 2 of the multi-blade fan 16 (not fan outlet side). In this case, in the backflow phenomenon in which part of the flow inside the casing enters between the blades, it was not possible to prevent entry of the backflow between the blades in advance. That is, backflow ends up entering inside the blades once, so the backflow interferes with the sucked in flow and the air flow between the blades is greatly disturbed. Therefore, worse noise and a lower flow rate (lower efficiency) are invited. Further, due to the provision of the plate 3' set from the blade inlet side, even when backflow is not formed, suction resistance is formed and the overall flow rate is lowered to thereby cause a drop in efficiency.

SUMMARY OF INVENTION

The present invention was made in consideration of the above problem and provides a centrifugal blower provided with a scroll casing for automobile air-conditioning use which is effective for reducing the noise level.

To solve this problem, centrifugal blower is provided with a multi-blade fan comprised of a large number of blades arranged in a circumferential direction at fixed intervals to form a fan wheel and of an air inlet provided upward in an axial direction of the fan wheel, the multi-blade fan having a fan outlet angle of the multi-blade fan in the range of an angle of 20° to 75° and having a fan wheel diameter in the range of 0.05 to 0.15D when an outside diameter of the multi-blade fan is D, and with a scroll chamber around the multi-blade fan surrounded by a spiral shaped casing which has an expansion angle of the spiral of an angular range of 2° to 6° from a spiral start part as the starting point, the spiral shaped scroll chamber having a chamber bottom part of the scroll chamber which gradually expands downward in the axial direction together with the expansion of the spiral and having a flow area which gradually increases toward an air outlet from the spiral start part, an initial slant angle $\theta_0$ downward in the axial direction at the spiral start part of the chamber bottom part being a range of angle of 5.2° to 27.5°.

Due to this, it is possible to change the shape of the chamber bottom part so as to improve the flow between blades and eddy formation and guide backflow well to the chamber bottom part so as to prevent the entry of an air flow between blades causing noise. Further, backflow is prevented and the formation of an eddy at the chamber bottom part is reduced, so the effect is obtained of reduction of the noise level and improvement of the fan efficiency.

The chamber bottom part is comprised of a slanted cross-sectional shape changing part as a boundary and a sharply slanted chamber bottom part from the spiral start part to the slanted cross-sectional shape changing part and a gently slanted chamber bottom part from the slanted cross-sectional shape changing part to the air outlet, the slanted cross-sectional shape changing part having an angle formed, with respect to an axis of the fan wheel, from the spiral start part to the circumferential direction of a range of angle of 30 to 60° and being positioned downward in the axial direction from the position of the chamber bottom part at the spiral start part within a range of 0.2 to 0.5H with respect to the fan wheel total height H of the multi-blade fan. Due to this, effects similar to the aspect of the invention according to claim 1 are obtained.

The sharply slanted chamber bottom part is comprised of a plurality of straight cross-sectional shapes. Due to this, it is possible to make the change in flow at the slanted cross-sectional shape changing part smoother.

The sharply slanted chamber bottom part is comprised of a curved cross-sectional shape. Due to this, it is possible to make the change in flow at the slanted cross-sectional shape changing part smoother.

A width W1 of a top surface of the scroll chamber is smaller than a width W2 of the chamber bottom part at any angle formed from the spiral start part to the circumferential direction with respect to an axis of the fan wheel from the spiral start part to the air outlet. Due to this, the flow toward the bottom becomes stronger, the flow toward the top becomes weaker, and the backflow no longer flows between the blades. For this reason, impact with the intake air flow is eliminated, so the noise level also becomes lower.

A centrifugal blower is provided with a multi-blade fan comprised of a large number of blades arranged in a circumferential direction at fixed intervals to form a fan wheel and an air inlet provided upward in an axial direction of the fan wheel, the multi-blade fan having a fan outlet angle of the multi-blade fan in the range of an angle of 20° to 75° and having a fan wheel diameter in the range of 0.05 to 0.15D when an outside diameter of the multi-blade fan is D, and with a scroll chamber surrounded, around the multi-blade fan, by a spiral shaped casing which has an expansion angle of the spiral of an angular range of 2° to 6° from a spiral start part as a start point, the spiral shaped scroll chamber having a chamber bottom part of the scroll chamber which gradually expands downward in the axial direction together with the expansion of the spiral and having a flow area which gradually increases toward the air outlet from the spiral start part, a backflow prevention rib being arranged at the scroll chamber at a top end of the fan outlet and with an angle formed from the spiral start part to the circumferential direction centered at the axis of the fan wheel of near 0° to 45° in range, a maximum width of the backflow prevention rib being made 0.1 to 0.3h1 in range with respect to a fan outlet length h1 measured from the top end of the fan outlet downward in the axial direction, the backflow prevention rib being provided separated by a predetermined distance from the fan outlet.

The backflow prevention rib 3 is set at the outlet side, so it is possible to prevent in advance any flow entering between the blades and thereby reduce the noise and increase the fan efficiency.

The angle formed by the maximum width of the backflow prevention rib with respect to the circumferential direction is a range of angle of 5° to 25°. Due to this, it is possible to suppress the backflow which often occurs in a range of an angle $\phi$ of 5° to 25°. This is much more effective for reduction of the noise level and increasing the efficiency of the fan.

At any angle of the angle formed by the circumferential direction, a width W1 of a case top surface of the scroll chamber is smaller than a width W2 of a case bottom surface of the chamber bottom part. Due to this, even when backflow easily occurs due to the width W1 of the case top surface, it is possible to prevent disturbance in the flow.

A centrifugal blower is provided with a multi-blade fan comprised of a large number of blades arranged in a circumferential direction at fixed intervals to form a fan wheel and an air inlet provided upward in an axial direction of the fan wheel, the multi-blade fan having a fan outlet angle of the multi-blade fan in the range of an angle of 20° to 75° and having a fan wheel diameter in the range of 0.05 to 0.15D when an outside diameter of the multi-blade fan is D, and with a scroll chamber surrounded, around the multi-blade fan, by a spiral shaped casing which has an expansion angle of the spiral of an angular range of 2° to 6° from a spiral start part as a start point, the spiral shaped scroll chamber having a chamber bottom part of the scroll chamber which gradually expands downward in the axial direction together with the expansion of the spiral and having a flow area which gradually increases toward the air outlet from the spiral start part, a backflow prevention rib being arranged at the scroll chamber at a top end of the fan outlet in a range from 45° (−45°) to one side of the circumferential direction to 45° (+45°) to the other side of the circumferential direction from the spiral start part as the starting point (0°) centered about the axis of the fan wheel, a maximum width of the backflow prevention rib being made 0.1 to 0.3h1 in range with respect to a fan outlet length h1 measured from the top end of the fan outlet downward in the axial direction, the backflow prevention rib being provided separated by a predetermined distance from the fan outlet.

Due to this, it is possible to prevent the air flow discharged from the multi-blade fan in the scroll chamber from striking the wall surfaces of the casing, striking the top of the fan wheel in the axial direction, or entering between the blades and possible to remarkably improve the noise level and the fan efficiency in the entire region of the range of use of the blower.

For the scroll chamber, a distance L1 between the fan outlet tip and the inner wall surface of the casing at the chamber bottom part of the spiral start part is 0.14D to 0.25D when the outside diameter of the multi-blade fan is D.

The backflow prevention rib has a trapezoid shape having the maximum width as its height, a bottom base of the trapezoid shape is formed at a top end of the fan outlet in a range from 45° (−45°) to one side of the circumferential direction to 45° (+45°) to the other side of the circumferential direction from the spiral start part as the starting point (0°) centered about the axis of the fan wheel, and two end points of the top base of the trapezoid shape are respectively provided in a range of 25° (−25°) to 5° (−5°) to one side of the circumferential direction and in a range of 5° (+5°) to 25° (+25°) to the other side of the circumferential direction from the spiral start part as the starting point (0°) centered about the axis of the fan wheel. Due to the large backflow in these ranges, a remarkable noise reduction effect is obtained.

Two multi-blade fans are joined at an opposite side from the air inlet.

Two multi-blade fans are joined at an opposite side from the air inlet.

Note that the above reference notations are examples showing the correspondence with specific embodiments explained later.

BRIEF DESCRIPTION OF DRAWINGS

FIG. 3A and FIG. 3B are explanatory views for explaining the flow between blades in a centrifugal blower, wherein FIG. 3A is an explanatory view showing an intake air flow in the case where a chamber bottom part of the scroll chamber 30 is not expanded downward, while FIG. 3B is an explanatory view showing an intake air flow in the case where a chamber bottom part of the scroll chamber 30 is expanded downward.

FIG. 4A is a graph showing the relationship between an initial slant angle $\theta_0$ and fan efficiency in an embodiment of the present invention, while

FIG. 5A is a graph showing the relationship between a circumferential direction angle $\phi$ of a slanted cross-sectional shape changing part 2*a* and fan efficiency in an embodiment of the present invention, while

FIG. 6A is an explanatory view explaining the state of air flow near a nose portion in the case where a slanted chamber bottom part 14 is a step-like extremely sharp slant, while

FIG. 8A is a graph showing the relationship between a flow coefficient and fan efficiency comparing the embodiment of the present invention of FIG. 7 with a comparative example, while

FIG. 12A is a graph showing the relationship between a ratio of a maximum width h2 with respect to a fan outlet length h1 and the fan efficiency of a backflow prevention rib 3 of the other embodiment of the present invention, while

FIG. 14A is a graph showing the relationship between the flow coefficient and fan efficiency of the other embodiment of the present invention compared with a conventional art with no backflow prevention rib 3, while FIG. 14B is a graph showing the relationship between the flow coefficient and specific noise level compared with the conventional art. FIG. 14C is a graph showing the relationship between the flow coefficient and pressure coefficient compared with the conventional art.

DESCRIPTION OF EMBODIMENTS

Figure 1:
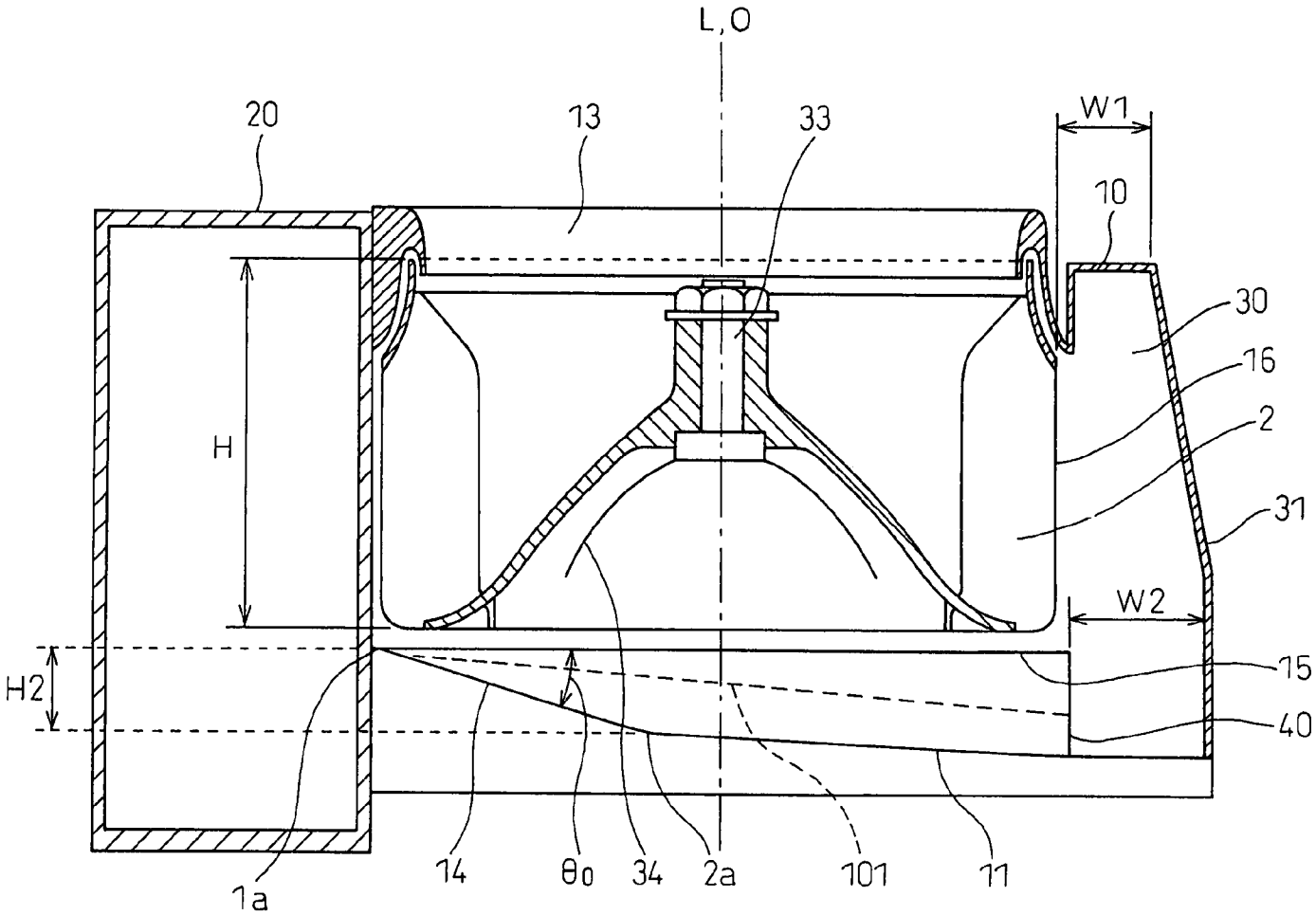
FIG. 1 is a cross-sectional view of a centrifugal blower in an embodiment of the present invention.

Below, referring to the drawings, embodiments of the present invention will be explained. In the embodiments, parts of the same constitutions are assigned the same notations and explanations are omitted. Parts of the same constitution with respect to the prior art as well are also assigned the same notations and explanations are omitted.

First Embodiment

FIG. 1 is a cross-sectional view of a centrifugal blower in an embodiment of the present invention.

The centrifugal blower is provided with a multi-blade fan 16 which has a large number of blades 2, a motor 34 to which this multi-blade fan 16 is attached, and a casing 31 which houses the multi-blade fan 16 inside of the casing 31 and which has a scroll chamber 30 formed in a spiral shape at an outer circumference side of the multi-blade fan. The multi-blade fan referred to here is also called a "sirocco fan". The casing 31 having the scroll chamber 30 is called a "scroll casing".

The casing 31 has an air inlet 13 at the surface of one side of the multi-blade fan 16 in the axial direction. If the motor 34 turns, the multi-blade fan 16 sucks in air from the air inlet 13 to the center part of the multi-blade fan 16. At the centrifugal blower, air is sucked into the center part of the multi-blade fan, then is given kinetic energy (dynamic pressure) by this multi-blade fan, has part of the dynamic pressure converted to static pressure in the casing while passing through the scroll chamber 30, and is discharged from the air outlet 20.

In a centrifugal blower in an embodiment of the present invention, the shape of the spiral forming the scroll casing has a spiral expansion angle of a range of angle of 2° to 6° from the spiral start part 1*a* as the starting point. The "expansion angle of the spiral" is explained as a logarithmic spiral function etc. (for example, see Japanese Unexamined Patent Publication No. 2004-270577, paragraph 0033, Japanese Unexamined Patent Publication No. 2003-193998, paragraph 0045, which corresponds to paragraph [0067] of US 2003/0012649 A1 etc.)

A large number of blades 2 are arranged in the circumferential direction at fixed intervals to form a fan wheel. An air inlet 13 is provided upward in the axial direction of the fan wheel. The "fan wheel" indicates, among the parts of the multi-blade fan 16, the part comprised of the large number of blades 2 arranged in the circumferential direction at fixed intervals in parallel in a cylindrical shape. The "axis of the fan wheel" indicates the center of rotation O of the multi-blade fan 16 (also called "axis of rotation O"). The electric motor 34 is a drive means for driving rotation of the multi-blade fan 16. This electric motor 34 is fixed in the casing 31, housing the multi-blade fan 16. In FIG. 1, H shows the fan wheel total height in the. direction of the axis of rotation (including top fan wheel ring).

Figure 2:
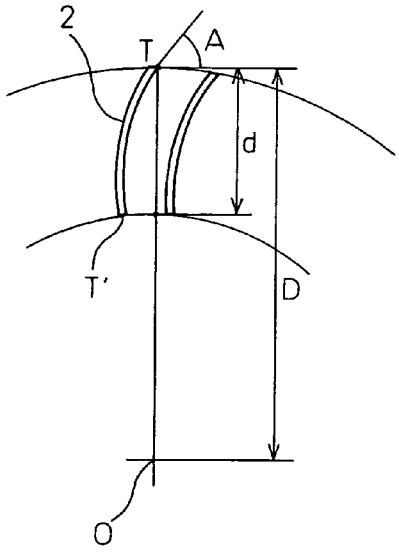
FIG. 2 is a cross-sectional view of blades in an embodiment of the present invention seen along an axial direction of a fan wheel.

FIG. 2 is a cross-sectional view of blades in an embodiment of the present invention as seen from an axial direction of the fan wheel. As shown in FIG. 2, the angle formed between tangential direction at an outlet tip of a blade 2 and a direction perpendicular to a line connecting the outlet tip T of the blade 2 and the center of rotation O is the "fan outlet angle" (fan outlet opening angle) A. In an embodiment of the present invention, the fan outlet angle A is in a range of angle of 20° to 75°. The distance connecting the outlet tip T of a blade 2 and the center of rotation O indicates the outside diameter D of the multi-blade fan 16. The "fan wheel diameter d" is the difference in the orbit radius between the outlet tip T and inside tip T' of a blade 2. In an embodiment of the present invention, the fan wheel diameter "d" is in a range of 0.05 to 0.15D when making the outside diameter of the multi-blade fan 16 D.

The casing 31 is formed in a substantially spiral shape so that a center axis O of the multi-blade fan 16 is positioned at the center axis L of the scroll chamber. At one end side of the casing 31 in the axial direction of the axis of rotation O (opposite side of the motor 34, here, referred to as "upward"), the air inlet 13 is formed for introduction of air. At the external edge of this air inlet 13, a bell mouth is provided for guiding the intake air smoothly to the multi-blade fan 16.

Figure 3A:
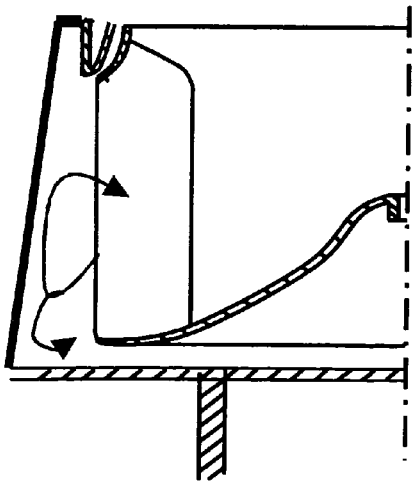
Figure 3B:
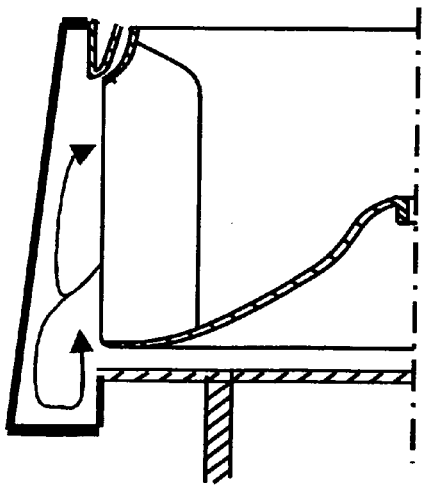

Up until now, it has been known that the cause of noise in a centrifugal blower was the interference at the scroll casing between the backflow air and intake air flow occurring near the spiral start part. In the present invention, the inventors researched in detail the backflow between blades and took note of the fact that the source of noise accompanying backflow is mainly the flow between blades. FIGS. 3A and 3B are explanatory views explaining the flow between blades at the centrifugal blower, wherein FIG. 3A shows the intake air flow in the case where the chamber bottom part of the scroll chamber 30 does not expand downward, while FIG. 3B shows the intake air flow in the case where the chamber bottom part of the scroll chamber 30 is made to expand downward.

In the case of FIG. 3A, the upward oriented flow becomes stronger and backflow ends up flowing between the blades. As opposed to this, in the case of FIG. 3B, the downward oriented flow becomes stronger, the upward oriented flow becomes weaker, and backflow no longer flows between the blades. Due to this, there is no longer any impact with the intake air flow, so the noise level also becomes lower.

Further, it was learned that the casing shape, in particular the shape of the chamber bottom part of the scroll chamber 30, can be further changed from the previous prior art to improve the flow between the blades. Below, the chamber bottom part of the scroll chamber 30 formed in a spiral shape at the outer circumferential side of the multi-blade fan will be explained with reference to FIG. 1. In the scroll chamber 30, the chamber bottom parts 14 and 11 of the scroll chamber 30 gradually expand downward in the axial direction along with the expansion of the spiral and the flow area gradually expands from the spiral start part 1*a* toward the air outlet 20.

In an embodiment of the present invention, the chamber bottom parts 14 and 11 are comprised of a slanted cross-sectional shape changing part 2*a* as a boundary and a sharply slanted chamber bottom part 14 from the spiral start part 1*a* to the slanted cross-sectional shape changing part 2*a* and a gently slanted chamber bottom part 11 from the slanted cross-sectional shape changing part 2*a* to the air outlet 20.

Further, the initial slant angle $\theta_0$ in the spiral start part 1*a* of the chamber bottom parts 14 and 11 (if expressed as one way, at the inside of the scroll chamber 30, the angle formed by the vertical plane with respect to the axis of rotation O at the inside cylindrical wall surface 40 near the chamber bottom part 14 when projecting and developing the chamber bottom part, see $\theta_0$ of FIG. 1) is in a range of angle of 5.2° to 27.5°, preferably a range of angle of 6.9° to 27.5°. Due to this, it was learned that the fan efficiency and the noise level are improved.

Figure 4A:
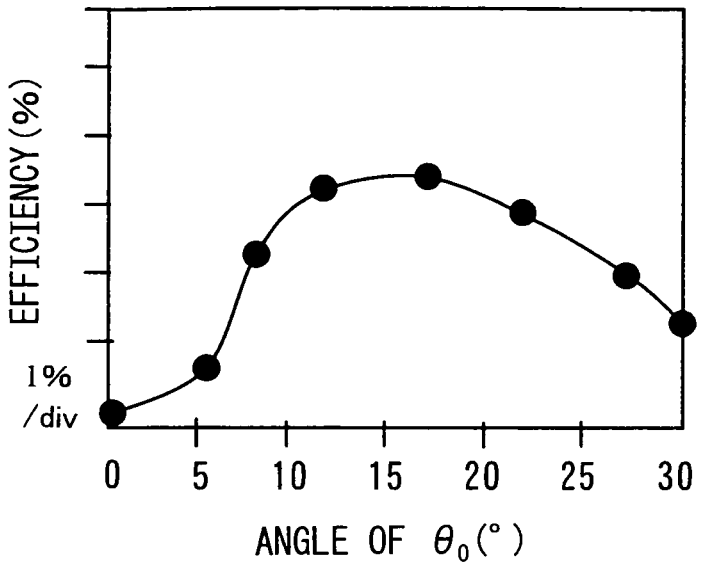
Figure 4B:
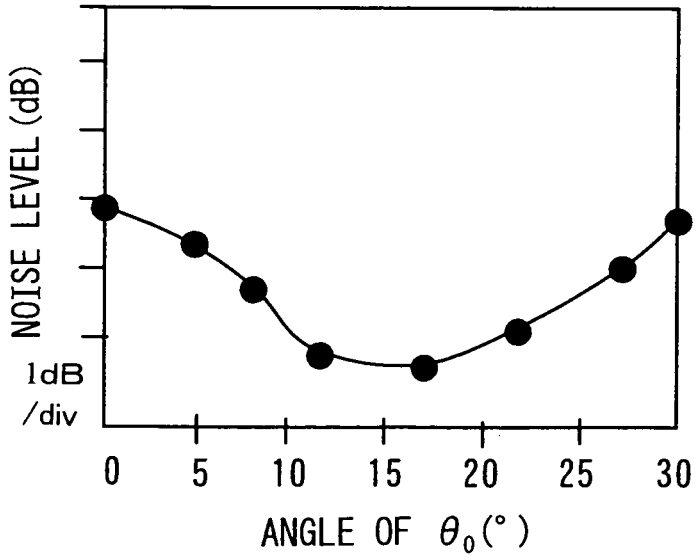
FIG. 4B is a graph showing the relationship between an initial slant angle $\theta_0$ and a noise level.

FIG. 4A is a graph showing the relationship between the initial slant angle $\theta_0$ and the fan efficiency in an embodiment of the present invention, while FIG. 4B is a graph showing the relationship between the initial slant angle $\theta_0$ and noise level. In this way, a clear effect is obtained when the initial slant angle $\theta_0$ is in the range of angle of 5.2° to 27.5°.

Figure 5A:
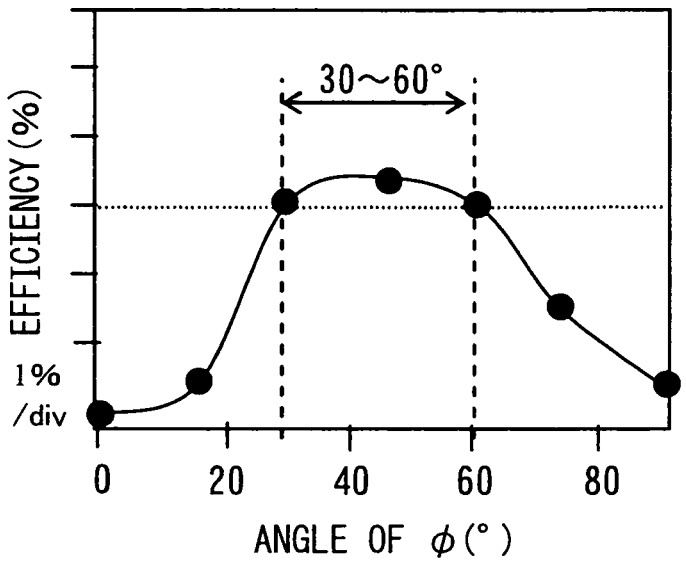
Figure 5B:
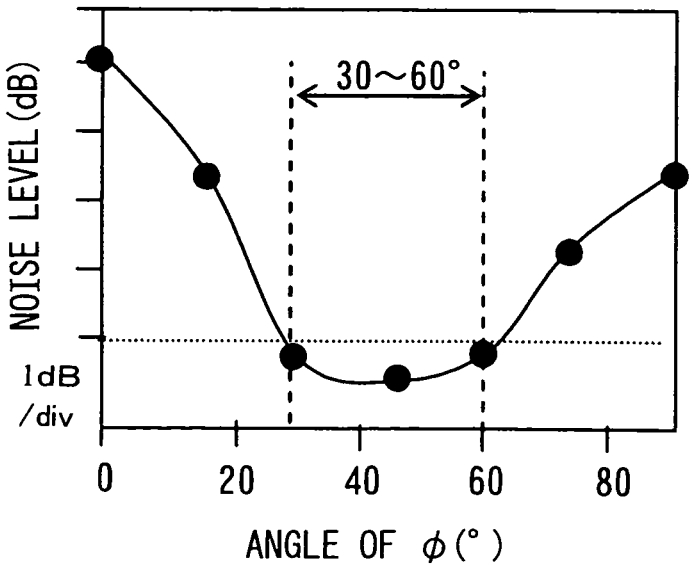
FIG. 5B is a graph showing the relationship between a circumferential direction angle $\phi$ of a slanted cross-sectional shape changing part 2*a* and a noise level.

In an embodiment of the present invention, when the circumferential direction angle of the "slanted cross-sectional shape changing part 2*a*" from the spiral start part 1*a* is $\phi$ (measured about axis of rotation O), the circumferential direction angle $\phi$ of "the slanted cross-sectional shape changing part 2*a*" may be made a range of angle of 30° to 60 from the spiral start part 1*a* to the circumferential direction and "the slanted cross-sectional shape changing part 2*a*" may be made a position of a range (H2) within 0.2 to 0.5H with respect to the fan wheel total height H of the multi-blade fan downward in the axial direction from the position at the chamber bottom part of the spiral start part 1*a*. FIG. 5A is a graph showing the relationship between the circumferential direction angle $\phi$ of "the slanted cross-sectional shape changing part 2*a*" and the fan efficiency in another embodiment of the present invention, while FIG. 5B is a graph showing the relationship between the circumferential direction angle $\phi$ of "the slanted cross-sectional shape changing part 2*a*" and the noise level. In this way, a clear effect is obtained when the circumferential direction angle $\phi$ of "the slanted cross-sectional shape changing part 2*a*" is a range of angle of 30 to 60°.

Figure 6A:
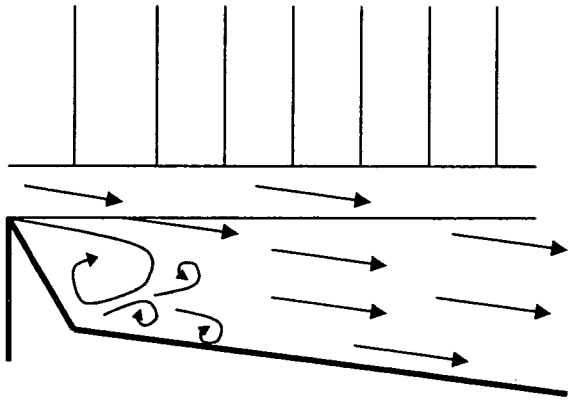
Figure 6B:
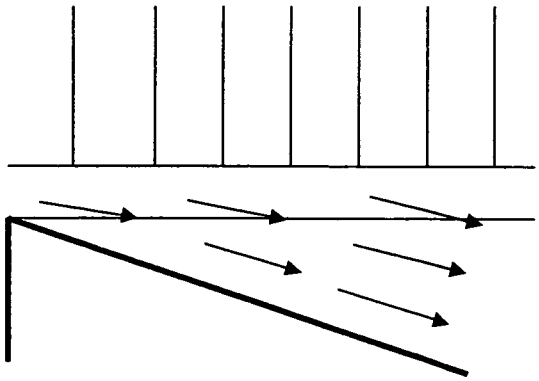
FIG. 6B is an explanatory view explaining the state of air flow near a nose portion in the case where the slanted chamber bottom part 14 is the present invention.

The framework by which the generation of noise is suppressed in the above embodiment will be explained next. FIG. 6A is an explanatory view explaining the state of the air flow near the nose portion in the case where the slanted chamber bottom part 14 is an extremely sharp slant like a step, while FIG. 6B is an explanatory view explaining the state of the air flow near the nose portion in the case where the slanted chamber bottom part 14 is the present invention. In the case like in FIG. 6A where the slanted chamber bottom part 14 is an extremely sharp slant like a step, the eddy flow becomes greater and becomes a cause of a drop in fan efficiency and greater noise. As opposed to this, as shown in FIG. 6B, when the initial slant angle $\theta_0$ is a range of angle of 5.2° to 27.5°, the flow lines become smooth and no disturbance occurs in the flow. In FIG. 1, W2 indicates the width of the chamber bottom parts 14 and 11 of the scroll chamber 30 in the radial direction of the multi-blade fan, while W1 means the distance between the outlet tips T of the blades 2 (outermost circumference of multi-blade fan 16) and the outermost circumference inner surface of the top surface 10 of the scroll chamber 30. Making W2 larger than W1 at all ϕ is effective without causing any disturbance in the flow.

Figure 7:
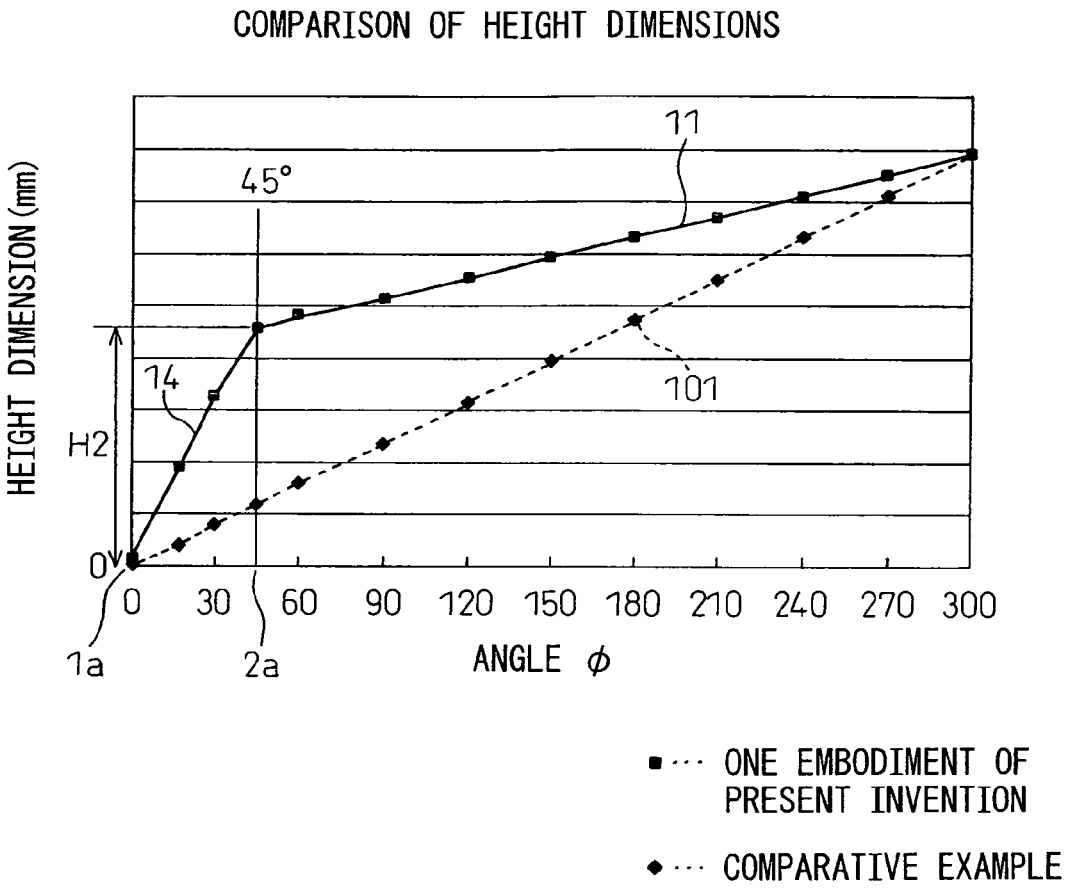
FIG. 7 is an example displaying the relationship between $\phi$ and H2 of an embodiment of the present invention.
Figure 8A:
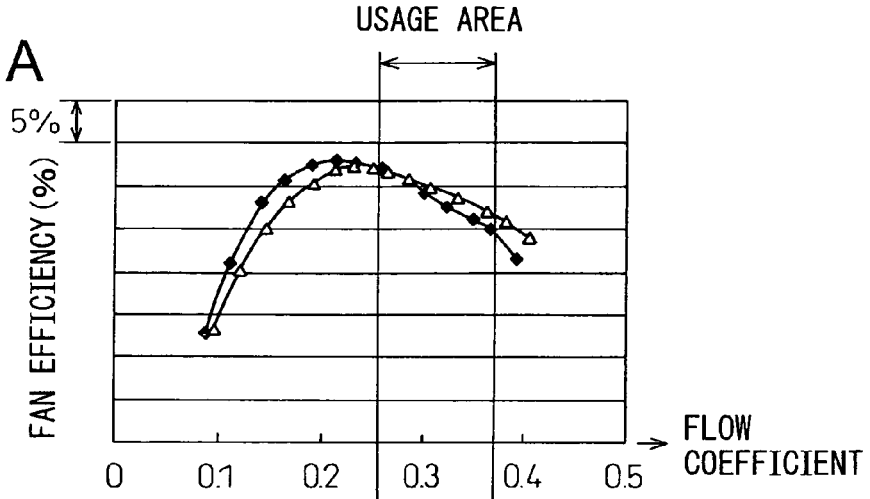
Figure 8B:
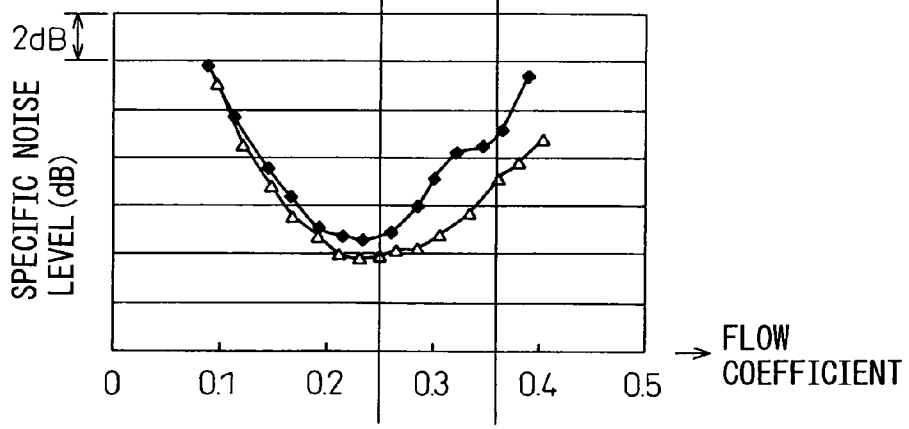
FIG. 8B is a graph showing the relationship between a flow coefficient and a specific noise level of the embodiment of the present invention of FIG. 7 compared with a comparative example.

FIG. 7 is an example showing the relationship between the angle ϕ and the position H2 of the changing part 2*a* in an embodiment of the present invention. Reference notation 101 is a comparative example where there is no slanted cross-sectional shape changing part 2*a* and the chamber bottom part changes by a fixed slant. FIG. 8A is a graph showing the relationship between the flow coefficient and the fan efficiency when comparing the embodiment of the present invention of FIG. 7 with a comparative example, while FIG. 8B is a graph showing the relationship between the flow coefficient and the specific noise level when comparing the embodiment of the present invention of FIG. 7 with a comparative example. The definitions and test methods of the specific noise level, flow coefficient, etc. are based on JIS (Japanese Industrial Standards).

In this example of an embodiment of the present invention, the slanted cross-sectional shape changing part 2*a* has a ϕ of 45°. The embodiment of FIG. 7 shows a typical shape of the chamber bottom part of the scroll chamber 30 of the present embodiment. At the slanted cross-sectional shape changing part 2*a*, the shape of the chamber bottom part from the spiral start 1*a* is changed to obtain the sharply slanted chamber bottom part 14. The flow sectional area of the case is sharply increased. The spiral start 1*a* is ϕ=0°, while the slanted cross-sectional shape changing part 2*a* is ϕ=45°. There is a gently slanted chamber bottom part 11 of a shape which gently expands downward from the slanted cross-sectional shape changing part 2*a* to the air outlet 20 at the spiral end. As shown in FIGS. 8A and 8B, an effect of use in the usage region is recognized compared with the case of the chamber bottom part of the comparative example of FIG. 7.

The air flow discharged from the multi-blade fan 16 strikes the nose portion and is rapidly changed in direction of flow, but due to the effect of the sharply slanted chamber bottom part 14, the flow is guided to the bottom direction whereby entry between the blades, the cause of noise, is prevented. As a result of research by the inventors, it has been learned that if quantitatively measuring the flow between blades, the effect of backflow is felt and noise is generated between blades in a specific range (0 to 45°). It is learned that in the flow inside the casing, the peripheral speed component accompanying rotation of the multi-blade fan is the largest. To prevent backflow between the blades, the cause of noise, due to this peripheral speed component, it was confirmed by experiments that a position of the slanted cross-sectional shape changing part 2*a* of 30° to 60° in range gives a particularly large effect. If ϕ=0 to 30°, a change ends up occurring in the sharp flow to the chamber bottom part, so the performance is no good. Further, if ϕ=60° or more, it is not possible to guide the backflow well to the case bottom and no effect arises.

Figure 9A:
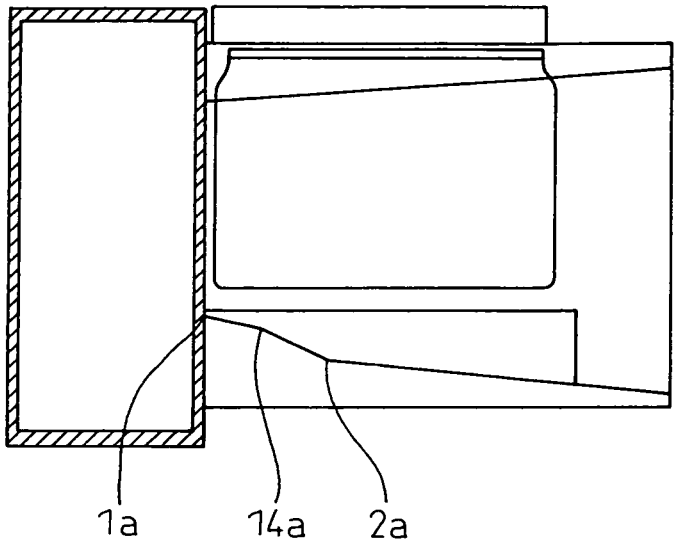
FIG. 9A and FIG. 9B are explanatory views showing modifications of an embodiment of the present invention.
Figure 9B:
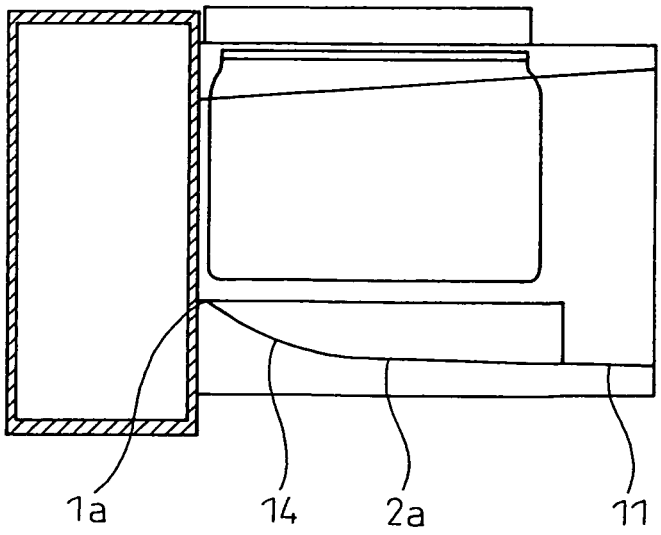

FIGS. 9A and 9B are explanatory views showing modifications of an embodiment of the present invention.

The modification of the embodiment of the present invention shown in FIG. 9A forms the sharply slanted chamber bottom part 14 from the spiral start part 1*a* to the slanted cross-sectional shape changing part 2*a* by a plurality of straight cross-sectional shapes. Here, two sections are shown, but a greater number of sections is also possible. Further, the modification of the embodiment of the present invention shown in FIG. 9B forms the slanted chamber bottom part 14 from the spiral start part 1*a* to the slanted cross-sectional shape changing part 2*a* by a curved cross-sectional shape. Here, these are examples of configuration by straight lines and curves. Both FIGS. 9A and 9B satisfy the requirements of the present invention. In addition, the gently slanted chamber bottom part 11 from the slanted cross-sectional shape changing part 2*a* to the air outlet 20 may also similarly be formed by a plurality of straight cross-sectional shapes.

Second Embodiment

Figure 10:
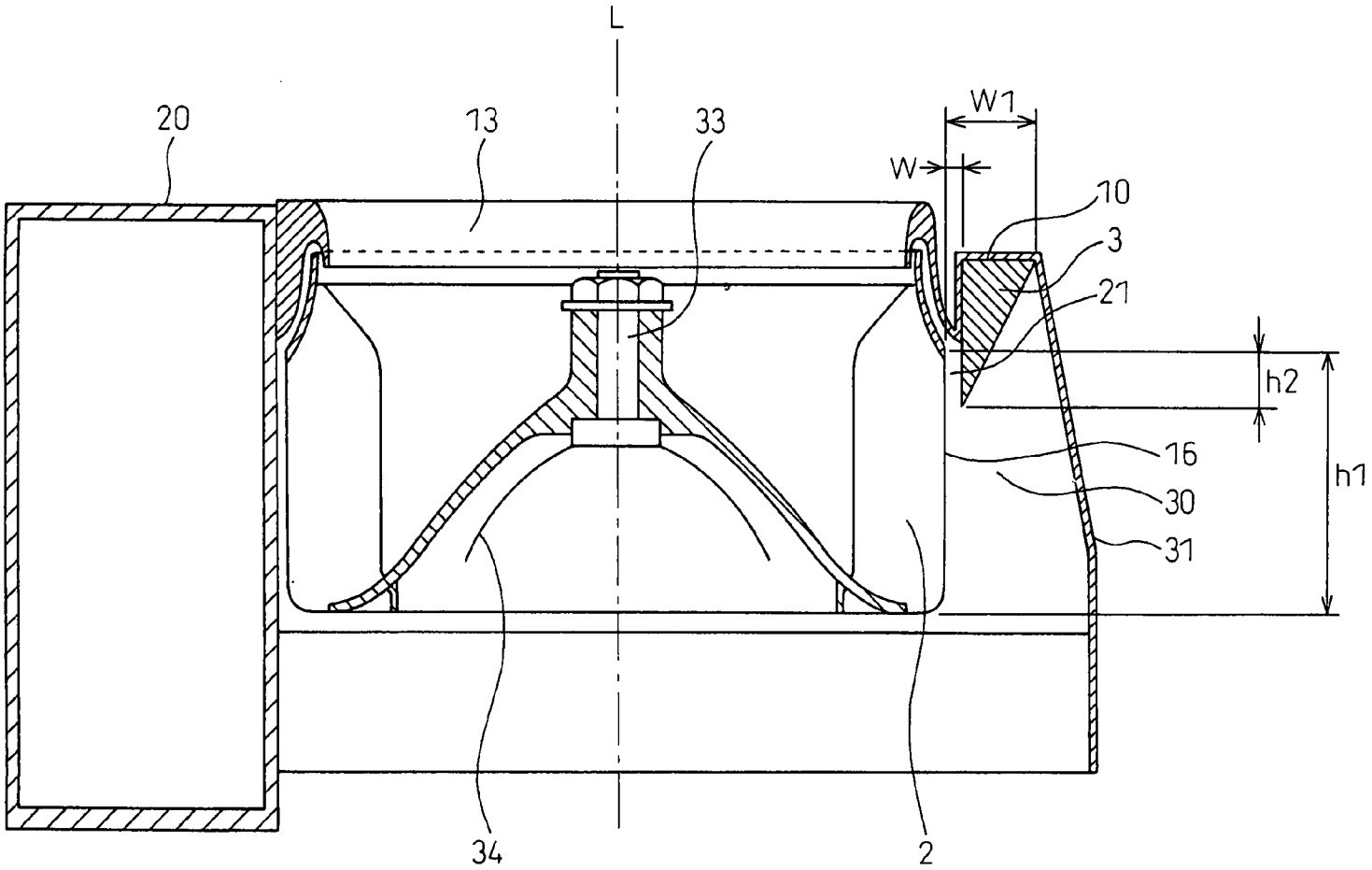
FIG. 10 is a cross-sectional view of a centrifugal blower in another embodiment of the present invention.
Figure 11:
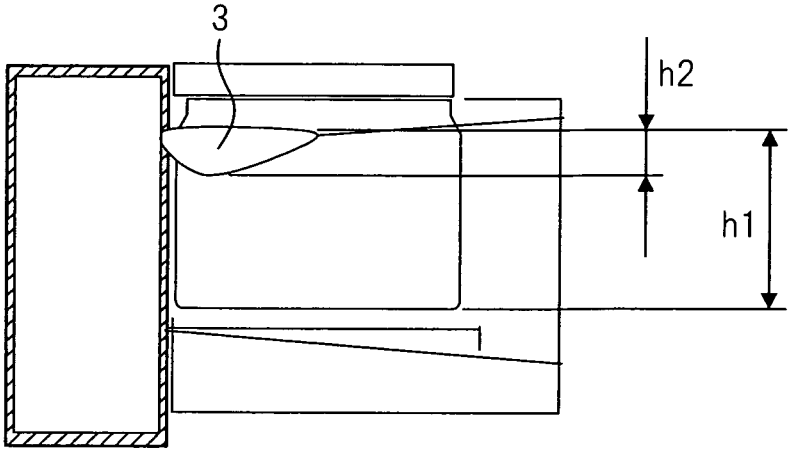
FIG. 11 is a schematic view for explaining a backflow prevention rib, a fan outlet length h1 and a maximum width h2.

FIG. 10 is a cross-sectional view of a centrifugal blower in another embodiment of the present invention. FIG. 11 is a schematic view explaining a backflow prevention rib. The other embodiment of the present invention is explained with reference to the case of application to a centrifugal blower provided with a scroll casing for automobile air-conditioning use, but is not limited to automobile air-conditioning use.

Below, referring to FIG. 10, another embodiment of the present invention will be explained. The centrifugal blower is provided with a multi-blade fan 16 having a large number of blades 2, a motor 34 to which this multi-blade fan 16 is attached, and a casing 31 which houses the multi-blade fan 16 inside of the casing 31 and has a scroll chamber 30 which is formed in a spiral shape at the outer circumference side of the multi-blade fan.

The casing 31 has an air inlet 13 at one surface of the multi-blade fan 16 in the axial direction. If the motor 34 rotates, the multi-blade fan 16 sucks in the air from the air inlet 13 to the center part of the multi-blade fan 16. In the centrifugal blower, the air is sucked into the center part of the multi-blade fan, then is given kinetic energy (dynamic pressure) by this multi-blade fan, has part of the dynamic pressure converted to static pressure inside of the casing while passing through the scroll chamber 30, and is discharged from the air outlet 20.

In the centrifugal blower in the other embodiment of the present invention, the spiral forming the scroll casing is shaped with an expansion angle of the spiral of a range of angle of 2° to 6° from the spiral start part 1*a* as the starting point. A large number of blades 2 are arranged in the circumferential direction at constant intervals to form a fan wheel. The air inlet 13 is provided in the axial direction of the fan wheel. The electric motor 34 is a drive means for driving rotation of the multi-blade fan 16. This electric motor 34 is fixed to the casing 31 housing the multi-blade fan 16.

As shown in FIG. 2, the angle formed by the tangential direction at an outlet tip of a blade 2 and a line connecting the outlet tip T of the blade 2 and the center of rotation O is the "fan outlet angle A". In an embodiment of the present invention, the fan outlet angle A is in a range of angle of 20° to 75°. The distance connecting an outlet tip T of a blade 2 and the center of rotation O indicates the outside diameter D of the multi-blade fan 16. The "fan wheel diameter d" is the difference of the orbit radius between an outlet tip T of a blade 2 and an inside tip T'. In an embodiment of the present invention, the fan wheel diameter "d" is in a range of 0.05 to 0.15D when the outside diameter of the multi-blade fan 16 is D.

The casing 31 is formed in a substantially spiral shape so that the axis of rotation O of the multi-blade fan 16 is positioned at the center axis L of the scroll chamber.

At one end of the casing 31 in the axial direction of the axis of rotation O (opposite side from motor 34, here, referred to as "upward"), an air inlet 13 is formed for introducing air. At the outer edges of this air inlet 13, a bell mouth is provided which guides intake air smoothly to the multi-blade fan 16. The center axis L of the scroll chamber and the axis of rotation O of the multi-blade fan 16 match.

If the multi-blade fan 16 sucks in air from the air inlet 13 to the center part of the multi-blade fan 16, the air is sucked into the center part of the multi-blade fan, then is given kinetic energy (dynamic pressure) by this multi-blade fan and is discharged from the fan outlet (outlet of blades 2) to the scroll chamber 30.

The chamber bottom part of the scroll chamber 30, formed in a spiral shape at the outer circumference side of the multi-blade fan, will be explained with reference to FIG. 10. The scroll chamber 30 gradually expands downward in the axial direction at the chamber bottom part 101 of the scroll chamber 30 and gradually increases in flow area from the spiral start part 1*a* toward the air outlet 20 along with the expansion of the spiral. In the present embodiment, a chamber bottom part 101 slanted in a straight line from the spiral start part 1*a* is formed (chamber bottom part may also be formed by a plurality of straight slanted parts or by a partially curved line). After this, the air has part of its dynamic pressure converted to static pressure inside of the casing while passing through the scroll chamber 30 and then is discharged from the air outlet 20.

W2 indicates the width of the chamber bottom part 101 of the scroll chamber 30 in the radial direction of the multi-blade fan 16 (also referred to as the "width of the case bottom surface"), while W1 indicates the distance between the outlet tips T of the blades 2 (outermost circumference of multi-blade fan 16) and the outermost circumference inner surface of the top surface 10 of the scroll chamber 30 or the width of the top surface of the scroll chamber 30 (also referred to as the "width of the case top surface"). The widths W1 and W2 of the case top surface and case bottom surface of the scroll chamber 30 may be made the same or different.

Next, the backflow prevention rib 3 will be explained. In the other embodiment of the present invention, at the top end of the fan outlet, the backflow prevention rib 3 is set in the casing 31 forming the scroll chamber 30 over a range of an angle ϕ from the spiral start part 1*a* to the circumferential direction centered about the axis of the fan wheel of near 0° to 45°. "Near 0°" indicates a range of around 0° to 2 or 3°. At the very least, a range of 0° to 45° may be included. Further, the maximum width h2 of the backflow prevention rib 3, measured from the top end of the fan outlet downward in the axial direction, is made a range of 0.1 to 0.3h1 with respect to the fan outlet length h1. As shown in FIG. 10, the cross-section appearing in the radial direction of the multi-blade fan 16 of the backflow prevention rib 3 is a right angle triangle. In this case, it is possible to make the backflow ascend or descend smoothly. In FIG. 10, the top surface of the scroll chamber 30 is completely covered by the backflow prevention rib 3, but the entire top surface does not necessarily have to be covered. Part of the top surface of the scroll chamber 30 may also be exposed.

The W in FIG. 10 is the distance between the fan outside diameter end and the backflow prevention rib. The backflow prevention rib 3 is set as shown in FIGS. 10 and 11 so as to be separated from the fan outlet by exactly a predetermined distance W. Regarding the predetermined distance W, this should be a distance determined so that rotation of the multi-blade fan 16 and flow of the channel are not obstructed. It is set to a predetermined value as suitable design matter. This distance W is preferably 2 mm or less. If separated by 5 mm or so, the action and effect of the present invention end up being reduced. Further, if closer than about 2 mm, the problem arises of impact due to uneven rotation of the fan. Therefore, in most cases, substantially, a distance W of about 2 mm is suitable.

Figure 12A:
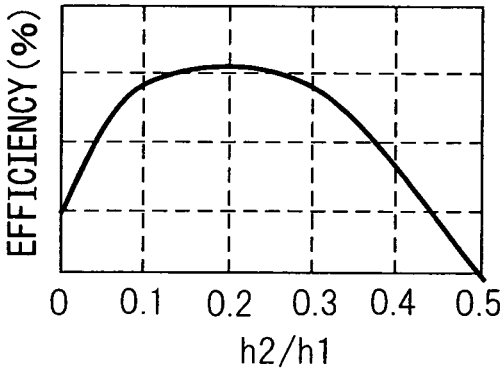
Figure 12B:
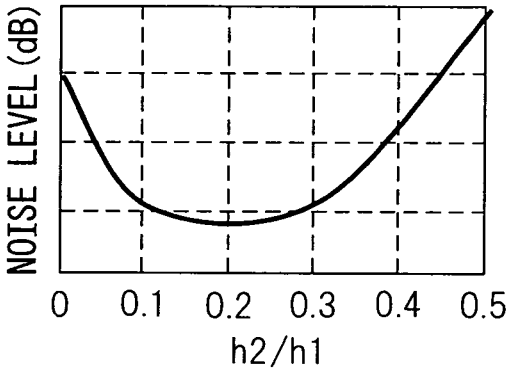
FIG. 12B is a graph showing the relationship between the maximum width h2 with respect to the fan outlet length h1 and the noise (specific noise level).

FIG. 12A is a graph showing the relationship between the ratio of the maximum width h2 (measured in the axial direction) of a backflow prevention rib 3 with respect to the fan outlet length h1 and the fan efficiency of an embodiment of the present invention, while FIG. 12B is a graph of the relationship between the ratio of the maximum width h2 with respect to the fan outlet length h1 and the noise level (specific noise level). If making the ratio with respect to the fan outlet length h1 (height of blades in axial direction at fan outlet) a range of 0.1 to 0.3h1, the fan efficiency is good, the noise level becomes low, and a special effect is caused. If less than 0.1h1, the effect of the backflow prevention rib 3 is reduced and backflow ends up entering between the blades. Further, if larger than 0.3h1, the air flow discharged from the blade 2 is obstructed and interference caused and therefore both the fan efficiency and noise level deteriorate.

Figure 13:
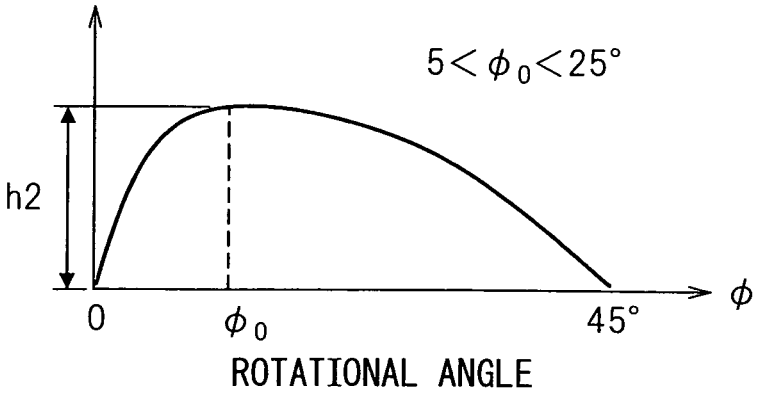
FIG. 13 is an example of the shape of the backflow prevention rib 3 showing the relationship between the angle $\phi$ from a spiral start part 1*a* to the circumferential direction and the maximum width h2.

FIG. 13 is an example of the shape of the backflow prevention rib 3 showing the relationship of the angle ϕ formed from the spiral start part 1*a* to the circumferential direction and the maximum width h2 (upward of the ordinate of FIG. 13, downward at FIG. 10). If the angle ϕ from the maximum width h2 of the backflow prevention rib 3 to the circumferential direction is in the range of angle of 5° to 25°, a noise reduction effect is obtained. This is because, as a result of measurement of the flow in the case and flow between blades by visual analysis, if the angle ϕ is in the range of angle of 5° to 25°, the backflow is large, so if making the position of the angle ϕ at which the maximum width h2 is formed this range of angle, the noise reduction is good. The shape of the backflow prevention rib 3 is not limited to the single example of FIG. 13. It may be a triangle, trapezoid shape, etc. In the same way, if the angle ϕ from the maximum width h2 to the circumferential direction is in the range of angle of 5° to 25°, a noise reduction effect is obtained.

Figures 14A, 14B, 14C:
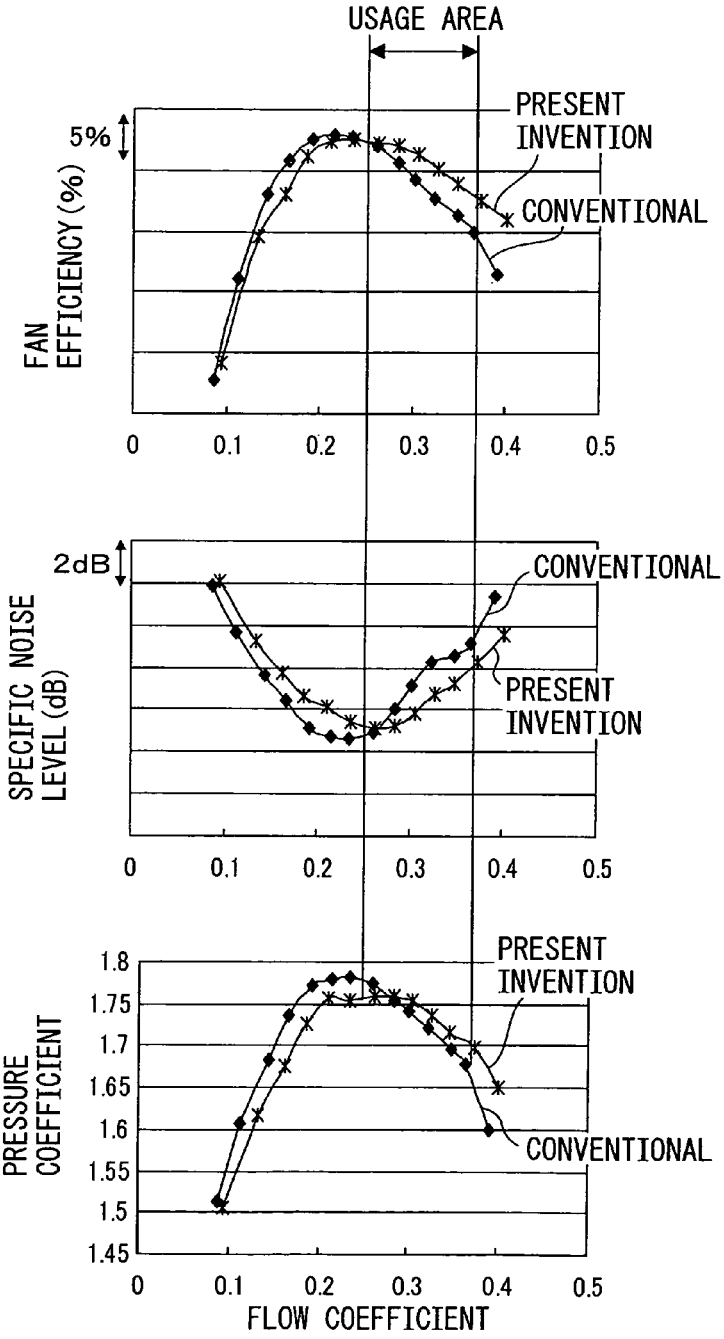

FIG. 14A is a graph showing the relationship between the flow coefficient and fan efficiency of another embodiment of the present invention compared with a conventional art with no backflow prevention rib 3, while FIG. 14B is a graph showing the relationship between the flow coefficient and specific noise level compared with the conventional art. FIG. 14C is a graph showing the relationship of the flow coefficient and pressure coefficient compared with the conventional art. The specific noise level, pressure coefficient, flow coefficient, etc. are defined as in JIS. Further, the test methods are also based on JIS. Note that the same applies to FIGS. 12A and 12B as well. As shown in FIGS. 14A to 14C, compared with the conventional art in FIGS. 14A to 14C, the effect of the region of use is recognized in the other embodiment of the present invention.

Figure 15:
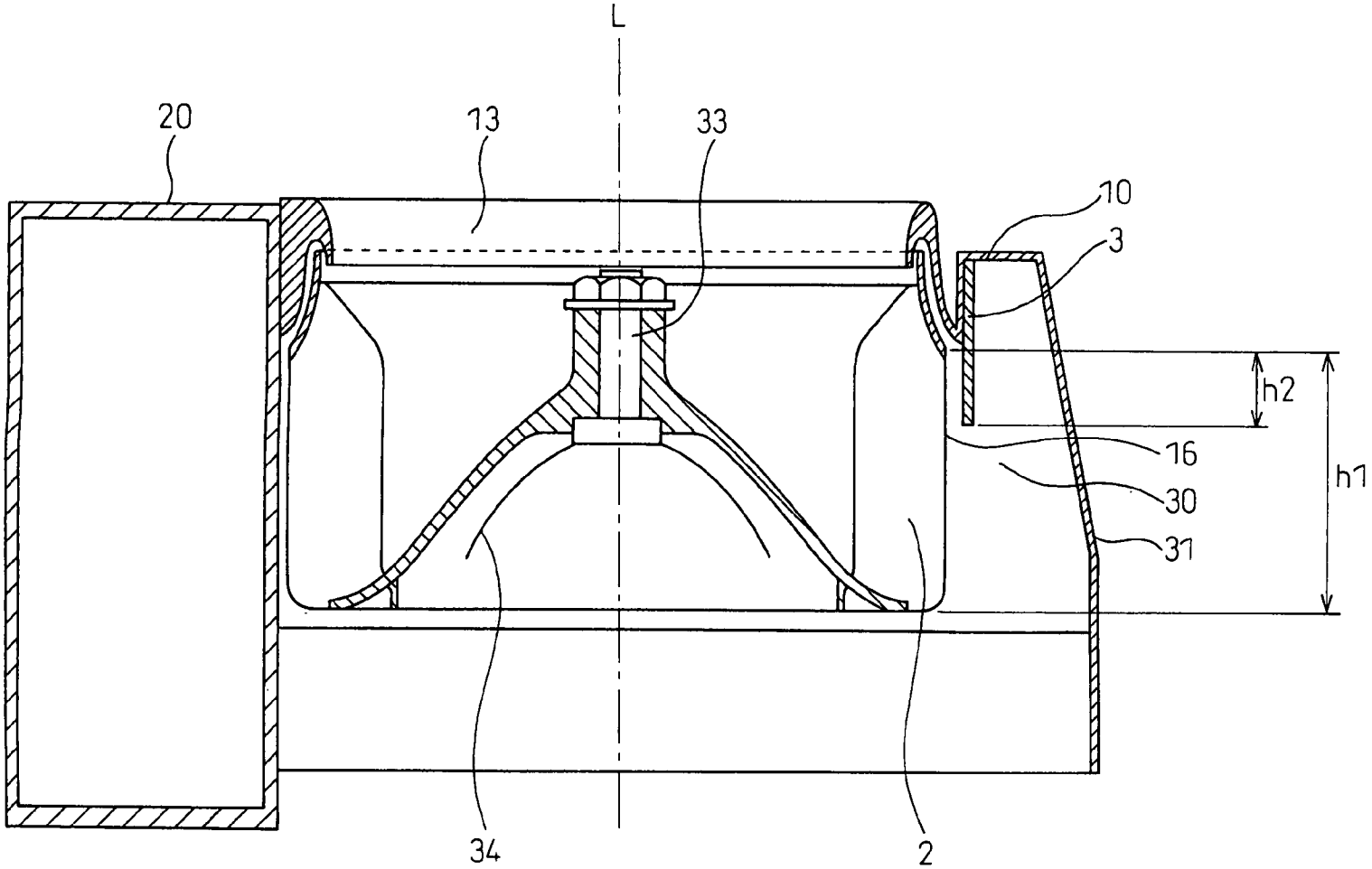
FIG. 15 is a cross-sectional view explaining a modification of a backflow prevention rib in the other embodiment of the present invention.
Figure 16:
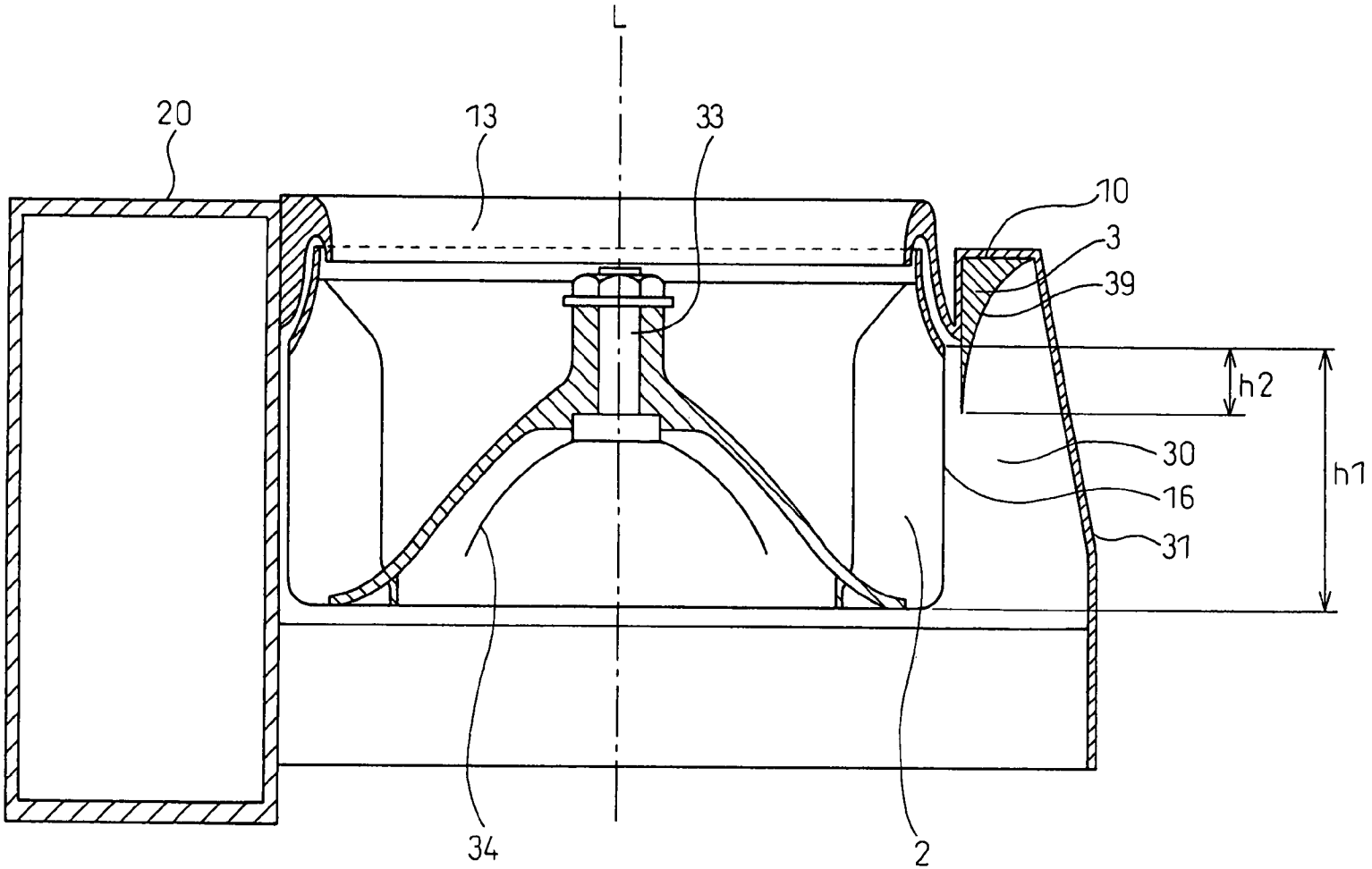
FIG. 16 is a cross-sectional view explaining a modification of a backflow prevention rib in the other embodiment of the present invention.

FIGS. 15 and 16 are cross-sectional views explaining a backflow prevention rib in a modification of the other embodiment of the present invention. In the modification of the other embodiment of the present invention of FIG. 15, the backflow prevention rib 3 becomes plate shaped in cross-section. In the modification of the other embodiment of the present invention of FIG. 16, the backflow prevention rib 3 has a curved recess 39 in the cross-section cut in the radial direction of the multi-blade fan 16. In this case, it is possible to make the backflow ascend or descend much more smoothly and suppress formation of eddy current. In FIG. 16, the top surface of the scroll chamber 30 is completely covered by the backflow prevention rib 3, but the entire top surface does not necessarily have to be covered. Part of the top surface of the scroll chamber 30 may also be exposed.

In the other embodiment of the present invention, the widths W1 and W2 of the top surface and bottom surface of the scroll chamber 30 may be made different. In the other embodiment of the present invention, as shown in FIG. 10, sometimes it is preferable to make W2 larger than W1 at all ϕ. Depending on the width W1 of the case top surface, sometimes backflow easily occurs, so doing this is effective since the flow is not disturbed.

Third Embodiment

Figure 17:
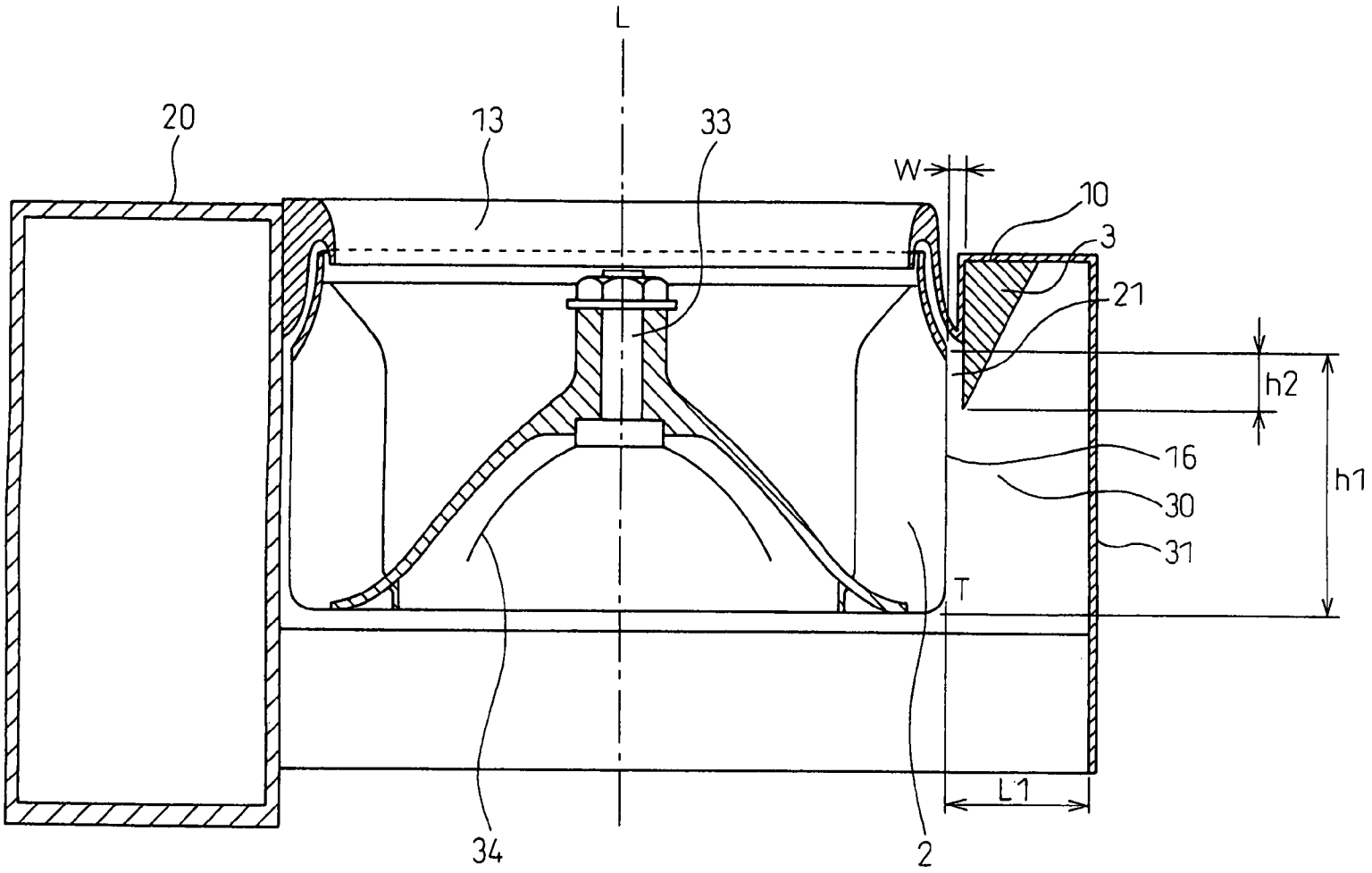
FIG. 17 is a cross-sectional view of a centrifugal blower in the other embodiment of the present invention.
Figure 18:
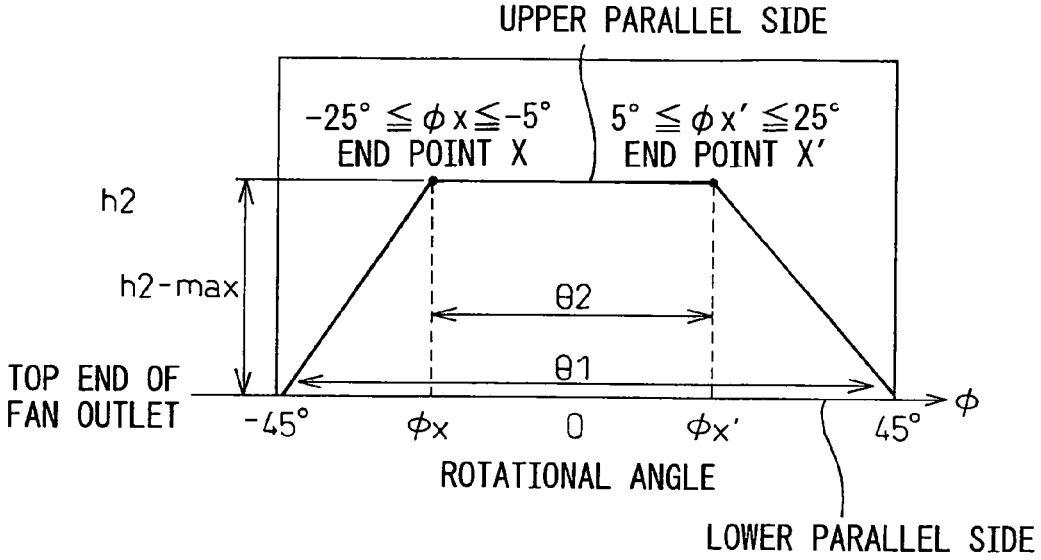
FIG. 18 is an example of the shape of the backflow prevention rib 3 showing the relationship between the angle $\phi$ from a spiral start part 1*a* to the circumferential direction and the maximum width h2 in the other embodiment of the present invention.
Figure 19:
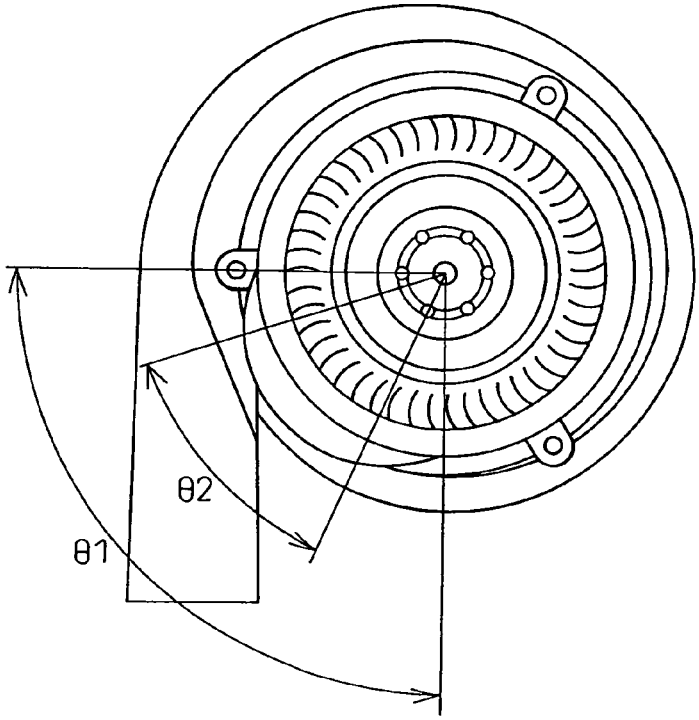
FIG. 19 is planar cross-sectional view in the other embodiment of the present invention.

Next, another embodiment of the present invention will be explained. FIG. 17 is a cross-sectional view of a centrifugal blower in the other embodiment of the present invention. FIG. 18 shows an example of the shape of the backflow prevention rib 3 showing the relationship between the angle ϕ from the spiral start part 1*a* to the circumferential direction and the maximum width h2 in the other embodiment of the present invention. FIG. 19 is a plan cross-sectional view in the other embodiment of the present invention.

In the other embodiment of the present invention, as shown in FIGS. 17 and 18, the backflow prevention rib 3 is shaped set in the scroll chamber 30 at the top end of the fan outlet in a range from 45° (−45°) at one side in the circumferential direction to 45° (+45°) at the other side in the circumferential direction from the spiral start part 1*a* as the starting point (0°). Further, the maximum width h2 of the backflow prevention rib 3, measured downward in the axial direction from the top end of the fan outlet, is made a range of 0.1 to 0.3h1 with respect to the fan outlet length h1.

Figure 20A:
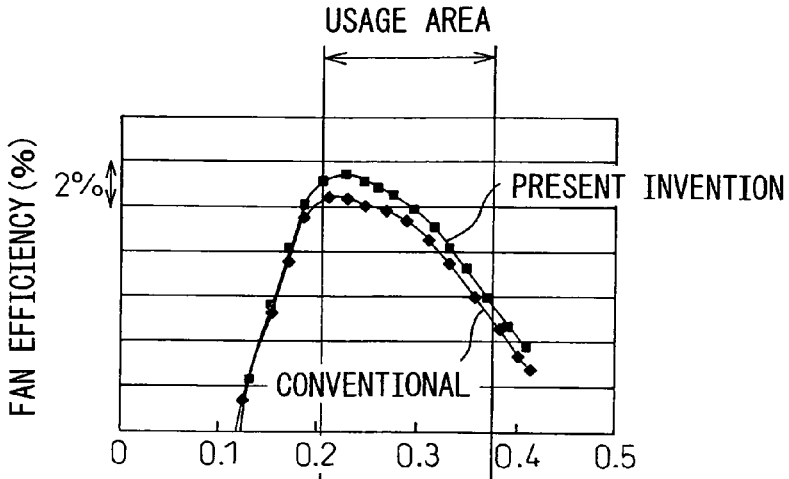
FIG. 20A is a graph showing the relationship between the flow coefficient and fan efficiency of the other embodiment of the present invention compared with the conventional art with no backflow prevention rib 3.
Figure 20B:
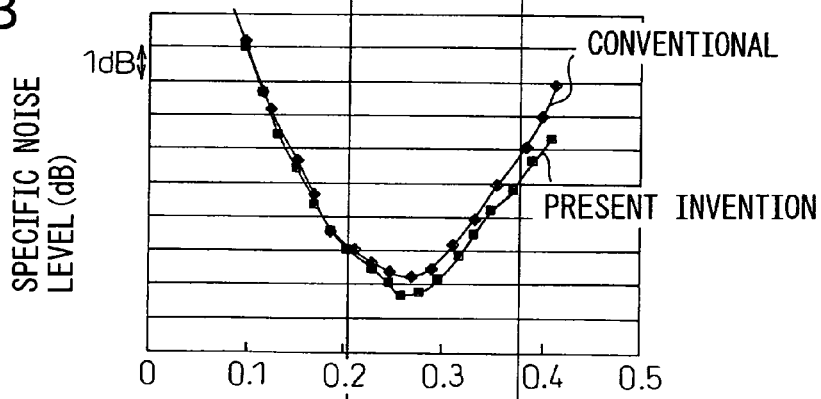
FIG. 20B is a graph showing the relationship between the flow coefficient and specific noise level compared with the conventional art.
Figure 20C:
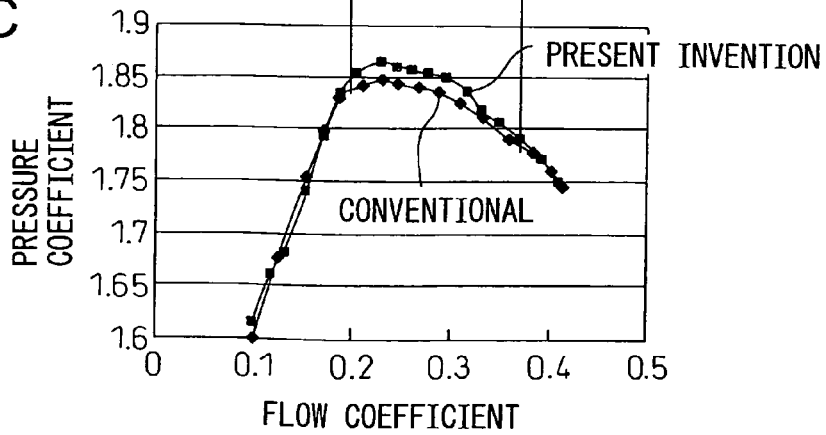
FIG. 20C is a graph showing the relationship between the flow coefficient and pressure coefficient compared with the conventional art.

FIG. 20A is a graph showing the relationship of the flow coefficient and fan efficiency of the other embodiment of the present invention compared with a conventional art with no backflow prevention rib 3, while FIG. 20B is a graph showing the relationship of the flow coefficient and specific noise level compared with the conventional art. FIG. 20C is a graph showing the relationship of the flow coefficient and pressure coefficient compared with the conventional art.

The inventors visually analyzed the flow in the casing 31 and the flow between blades and accumulated further research findings. As a result, they learned that the range in which the noise level rises due to backflow is ±45 degrees from the spiral start 0 degree. According to the present embodiment, it is possible to prevent the air flow discharged from the multi-blade fan 16 from striking the wall surfaces of the casing 31 in the scroll chamber 30, or from striking the top of the fan wheel in the axial direction, or to prevent entry of backflow between the blades. In the entire range of use of the blower, it is possible to improve the noise to 0.8 dB and the efficiency to 1.5 pt.

If the maximum width h2 of the backflow prevention rib 3, measured downward in the axial direction from the top end of the fan outlet, is in a range of 0.1 to 0.3h1 with respect to the fan outlet length h1, a greater effect is exhibited. If 0.1h1 or less, the effect is reduced and the backflow ends up entering between the blades. Further, if 0.3h1 or more, the performance in obstructing and interfering with the air flow discharged from the multi-blade fan 16 and the noise level may both deteriorate.

In the scroll chamber 30, in the chamber bottom part 101 of the spiral start part 1*a*, the distance L1 between the fan outlet tips T and the inner wall surface of the casing 31 (see FIGS. 2 and 17) should be 0.14D to 0.25D when the outside diameter of the multi-blade fan 16 is D.

As shown in FIG. 18, the backflow prevention rib 3 is trapezoid shaped with the maximum width h2 (h2-max) as the height. The bottom base (lower parallel side) of the trapezoid shape is formed at the top end of the fan outlet in a range from 45° (−45°) at one side in the circumferential direction (minus side) to 45° (+45°) at the other side in the circumferential direction (plus side) from the spiral start part 1*a* as the starting point 0°. The two ends X, X' of the top base (upper parallel side) of the trapezoid shape are respectively preferably provided in the range from 25° (−25°) 5° (−5°) at one side in the circumferential direction (minus side) and in the range from 5° (+5°) to 25°(+25°) at the other side in the circumferential direction (plus side) from the spiral start part 1*a* as the starting point (0°). This is because as a result of measurement of the flow in the casing and the flow between blades by visual analysis, it was learned that the backflow prevention rib 3 gives a good noise reduction effect if the angular position where the length overlapping the top end of the fan outlet becomes the maximum width h2 is ±25 degrees. This is due to the fact that there is great backflow in this range. Note that the backflow prevention rib 3 was made a trapezoid shape, but it may also be formed with slanted surfaces which are not straight, but are uneven curves.

Figure 21:
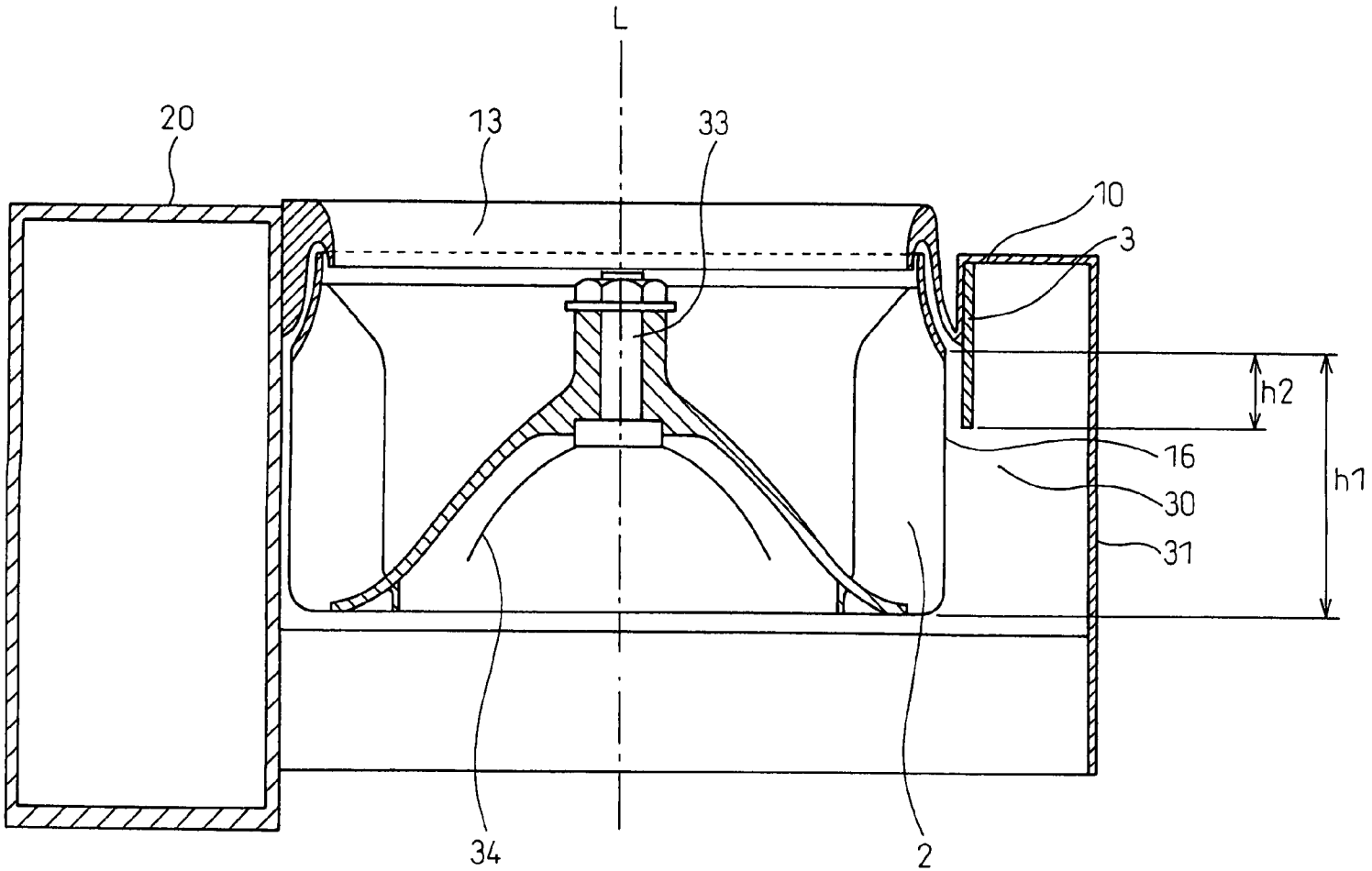
FIG. 21 is a cross-sectional view of a centrifugal blower in a modification of the other embodiment of the present invention.
Figure 22:
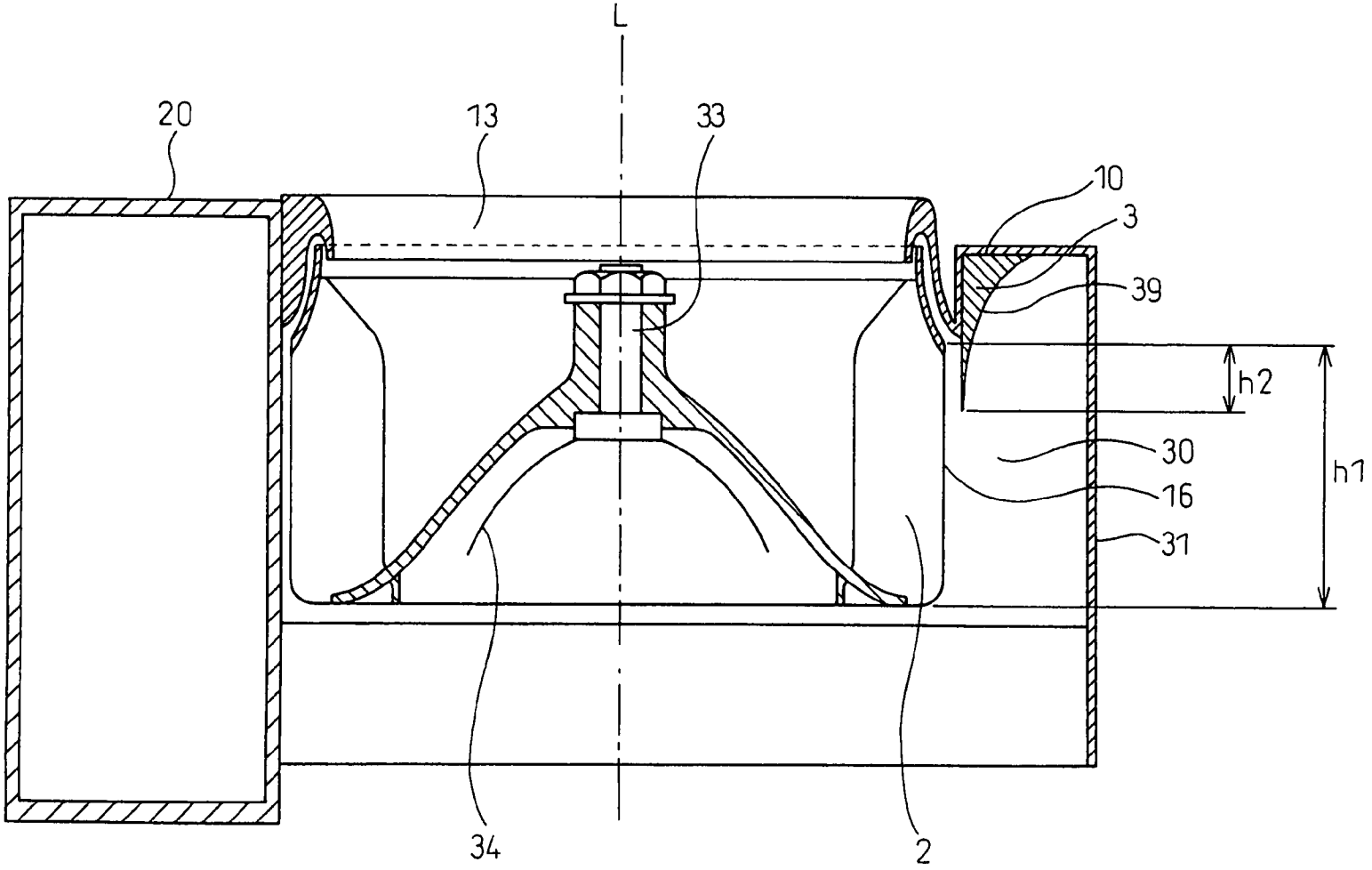
FIG. 22 is a cross-sectional view of a centrifugal blower in a modification of the other embodiment of the present invention.

FIGS. 21 and 22 are cross-sectional views of a centrifugal blower in a modification of the other embodiment of the present invention. In the same way as FIGS. 15 and 16, in FIG. 21, the backflow prevention rib 3 becomes plate shaped in cross-section. Further, in FIG. 22, the backflow prevention rib 3 has a recessed part 39 of a curved shape in the cross-section cut in the radial direction of the multi-blade fan. In this case, it is possible to make the backflow ascend or descend more smoothly to suppress formation of an eddy current.

In the embodiments of FIGS. 17, 21, and 22, the wall surfaces of the casing 31 are vertical, but may also be slanted as in FIGS. 10, 15, and 16.

Figure 23:
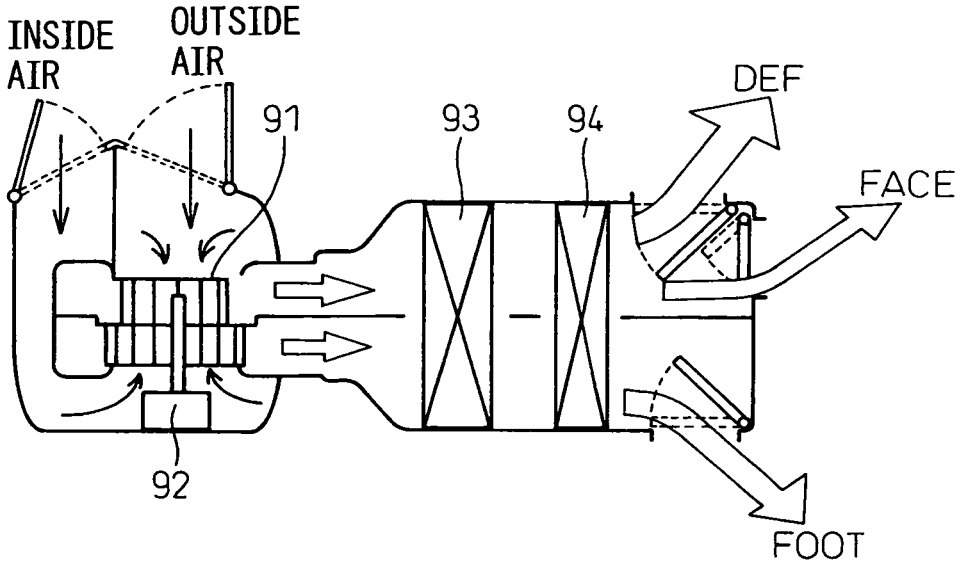
FIG. 23 is a cross-sectional view in the case of applying an embodiment of the present invention to an inside/outside air two-layer type air-conditioning unit.
Figure 24A:
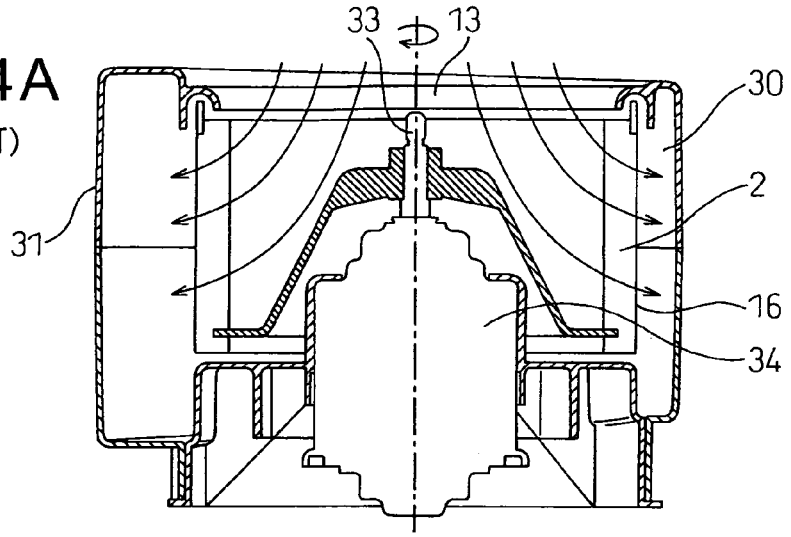
FIG.24A (PRIOR ART)
FIG. 24A is a cross-sectional view along an axial direction of a centrifugal blower of the prior art disclosed in Japanese Unexamined Patent Publication No. 2004-360497.
Figure 24B:
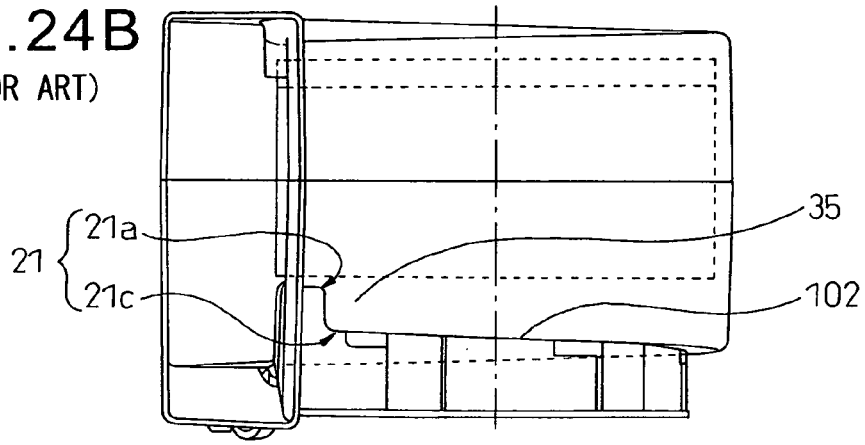
FIG.24B (PRIOR ART)
FIG. 24B is a front view.
Figure 24C:
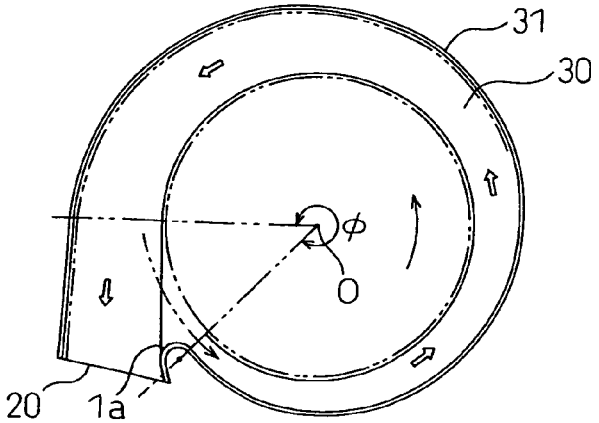
FIG.24C (PRIOR ART)
FIG. 24C is a plan cross-sectional view.
Figure 25:
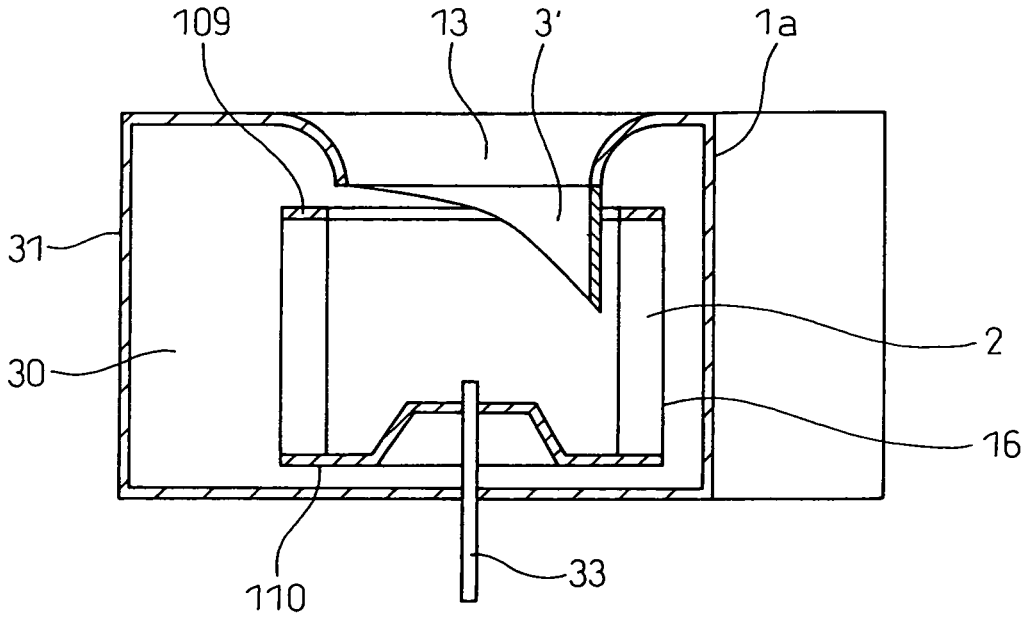
FIG.25 PRIOR ART
FIG. 25 is a cross-sectional view of a centrifugal blower of the prior art disclosed in Japanese Patent No. 3231679.

The above embodiments of the backflow prevention rib 3 of the present invention may be applied to a two-layer inside/outside air air-conditioning unit comprised of two multi-blade fans 16 joined at an opposite side from the air inlet 13. FIG. 23 is a cross-sectional view of the case of application of an embodiment of the present invention to a two-layer inside air/outside air air-conditioning unit. In FIG. 23, reference numeral 91 shows a centrifugal blower comprised of two multi-blade fans joined at the opposite side from the air inlet 13. The outside air is blown by the top stage multi-blade fan to the top stage layer. The inside air is blown by the bottom stage multi-blade fan to the bottom stage layer (there is also a mode in which the inside and outside air are mixed). Using an electric motor 92 which coaxially drives the top stage and bottom stage multi-blade fans, the inside and outside air which are blown to the top stage and bottom stage respectively become two layers, pass through the evaporator 93 and heater 94, and are sent to the inside of the chamber. The two-layer inside air/outside air air-conditioning unit to which the embodiment is applied is not limited to FIG. 23. It is also possible to apply the embodiment to a known two-layer inside air/outside air air-conditioning unit (as one example, as shown in detail in Japanese Unexamined Patent Publication No. 2000-016050 etc.)

The invention claimed is:

1. A centrifugal blower comprising a multi-blade fan comprised of a plurality of blades arranged in a circumferential direction at fixed intervals to form a fan wheel and an air inlet provided upward in an axial direction of the fan wheel, the plurality of blades having an outlet angle of the multi-blade fan in the range of an angle of 20° to 75° and having a fan wheel diameter in the range of 0.05 to 0.15D when an outside diameter of the multi-blade fan is D, and with a scroll chamber surrounded, around the multi-blade fan, by a spiral shaped casing which has an expansion angle of the spiral of an angular range of 2° to 6° from a spiral start part as a start point, the spiral shaped scroll chamber having a chamber bottom part of the scroll chamber which gradually expands downward in the axial direction together with the expansion of the spiral and having a flow area which gradually increases toward the air outlet from the spiral start part, a backflow prevention rib being arranged in the scroll chamber at a top end of the fan outlet and with an angle formed from the spiral start part to the circumferential direction centered at the axis of the fan wheel of 0° to 45° in range, a maximum width of the backflow prevention rib being made 0.1h1 to 0.3h1 in range, where h1 is a fan outlet length measured from the to end of the fan outlet downward in the axial direction to an end of the multi-blade fan, the backflow prevention rib being spaced a predetermined distance from the fan outlet; and a radially cut cross-section of the back flow prevention rib having a wider portion toward the to end of the fan outlet in the axial direction; wherein the backflow prevention rib has a triangular cross-section, a first side of the triangular cross-section being parallel to a scroll chamber to part and a second side of the triangular cross-section extending perpendicular to the first side; and the scroll chamber is defined by an inside wall and an outside wall of the spiral shaped casing, the outside wall is spaced from the inside wall in a direction away from the multi-blade fan and the second side of the triangular cross-section directly engages the inside wall.

2. A centrifugal blower comprising a multi-blade fan comprised of a plurality of blades arranged in a circumferential direction at fixed intervals to form a fan wheel and an air inlet provided upward in an axial direction of the fan wheel, the plurality of blades having an outlet angle of the multi-blade fan in the range of an angle of 20° to 75° and having a fan wheel diameter in the range of 0.05 to 0.15D when an outside diameter of the multi-blade fan is D, and with a scroll chamber surrounded, around the multi-blade fan, by a spiral shaped casing which has an expansion angle of the spiral of an angular range of 2° to 6° from a spiral start part as a start point, the spiral shaped scroll chamber having a chamber bottom part of the scroll chamber which gradually expands downward in the axial direction together with the expansion of the spiral and having a flow area which gradually increases toward the air outlet from the spiral start part, a backflow prevention rib being arranged in the scroll chamber at a top end of the fan outlet and with an angle formed from the spiral start part to the circumferential direction centered at the axis of the fan wheel of 0° to 45° in range, a maximum width of the backflow prevention rib being made 0.1h1 to 0.3h1 in range, where h1 is a fan outlet length measured from the to end of the fan outlet downward in the axial direction to an end of the multi-blade fan, the backflow prevention rib being spaced a predetermined distance from the fan outlet; and a radially cut cross-section of the back flow prevention rib having a wider portion toward the to end of the fan outlet in the axial direction; wherein the backflow prevention rib has a triangular cross-section, a first side of the triangular cross-section being parallel to a scroll chamber to part and a second side of the triangular cross-section extending perpendicular to the first side;

the first wall of the triangular cross-section directly engages a to wall of the spiral shaped casing; and at least a portion of the first wall extends an entire width of the top wall of the spiral shaped casing.

* * * * *

UNITED STATES PATENT AND TRADEMARK OFFICE

CERTIFICATE OF CORRECTION

PATENT NO. : 9,206,817 B2
APPLICATION NO. : 13/199400
DATED : December 8, 2015
INVENTOR(S) : Mitsuishi et al.

It is certified that error appears in the above-identified patent and that said Letters Patent is hereby corrected as shown below:

On the title page item [75]

Column 1, line 1, delete "Anjo" and insert -- Anjo, Aichi-pref. --;

Column 1, line 2, delete "Obu" and insert -- Obu, Aichi-pref. --;

Column 1, line 3, delete "Okazaki" and insert -- Okazaki, Aichi-pref. --;

Column 1, line 4, delete "Kariya" and insert -- Kariya, Aichi-pref. --;

Column 1, line 5, delete "Chiryu" and insert -- Chiryu, Aichi-pref. --;

In the claims

Column 15, claim 1, line 19, delete "to" and insert -- top --;

Column 15, claim l, line 25, delete "to" and insert -- top --;

Column 15, claim 1, line 29, delete "to" second occurrence and insert -- top --;

Column 16, claim 2, line 23, delete "to" and insert -- top --;

Column 16, claim 2, line 29, delete "to" and insert -- top --;

Column 16, claim 2, line 33, delete "to" second occurrence and insert -- top --; and, Column 16, claim 2, line 37, delete "to" and insert -- top --.

Signed and Sealed this
Twenty-sixth Day of July, 2016

Michelle K. Lee

Michelle K. Lee
*Director of the United States Patent and Trademark Office*